US005139580A

United States Patent [19]

Freier et al.

[11] Patent Number: 5,139,580

[45] Date of Patent: Aug. 18, 1992

[54] COLD ROLLED SHEET OR STRIP STEEL AND A PROCESS FOR PRODUCTION THEREOF

[75] Inventors: Klaus Freier; Walter Zimnik, both of Wolfenbüttel, Fed. Rep. of Germany

[73] Assignee: Stahlwerke Peine-Salzgitter AG, Peine, Fed. Rep. of Germany

[21] Appl. No.: 555,171

[22] Filed: Jul. 18, 1990

[30] Foreign Application Priority Data

Jan. 29, 1988 [DE] Fed. Rep. of Germany ..... 3803064
Dec. 22, 1988 [DE] Fed. Rep. of Germany ..... 3843732
Jan. 27, 1989 [WO] PCT Int'l Appl. ... PCT/DE89/00057

[51] Int. Cl.[5] ..... C21D 8/04
[52] U.S. Cl. ..... 148/547; 148/320
[58] Field of Search ..... 148/320, 12 C, 12 F

[56] References Cited

U.S. PATENT DOCUMENTS 4,517,031 5/1985 Takasaki et al. ..... 148/12 C
4,889,566 12/1989 Okada et al. ..... 148/12 C

FOREIGN PATENT DOCUMENTS 3234574 4/1983 Fed. Rep. of Germany .
57-104627 6/1982 Japan ..... 148/12 C

OTHER PUBLICATIONS

Blech, Rohre, Profile (Sheet, Tubing, Sections), Singer, H., No. 9/1977, pp. 341-346.

*Primary Examiner*—Deborah Yee
*Attorney, Agent, or Firm*—Thomas N. Ljungman

[57] ABSTRACT

In order to produce sheet possessing good forming properties, in particular for rotationally symmetrical deep-drawings, a low-carbon steel containing not more that 0.009% N is alloyed with 0.01 to 0.94% Ti and in certain cases with 0.01 to 0.06% Nb and continuously cast. The plate slabs are heated to a temperature above 1120 degrees Celsius, rolled to obtain a hot strip above the $Ar_3$ point, and would at 520±100 degrees Celsius. After cold rolling to the desired fine sheet thickness, the steel strip is annealed by recrystallizaiton, skin-passes and made into sheets.

28 Claims, 19 Drawing Sheets

COLD ROLLED SHEET OR STRIP STEEL AND A PROCESS FOR PRODUCTION THEREOF

BACKGROUND OF THE INVENTION

1. Field of the Invention

The present invention relates to a process for the production of sheet or strip steel, as well as to a sheet or strip steel particularly suitable for deep drawing.

For the deep drawing of rotationally symmetrical steel parts, the most texture-free possible cold rolled strip or sheet is preferably used, so that quasi-isotropic reforming is possible, and so that the drawn part is relatively ear-free. By relatively "ear-free", it is meant that a cylindrical deep drawn part, for example, will not have a wavy edge.

Complete absence of earing can normally only be expected when using isotropic material without segregations, without nonmetallic inclusions, without pearlite-cementite precipitations, and with a relatively pancake-free texture.

2. Background Information

In BLECH, ROHRE, PROFILE [Sheet, Tubing, Sections], No. Sep. 1977, pp. 341-346, the cause of earing is described in some detail, and a measurement of the relative ear height Z and the planar anisotropy delta r are defined. In each case, results with the value zero (or relatively ear-free material) would be ideal.

In this document, the value for the planar anisotropy is calculated from the anisotropy r for various expansion behaviors of the material in the direction of rolling, as well as at angles of 45 and 90 degrees thereto. Various adjustments of the r-values to provide different deep drawing characteristics are possible.

For the steels mentioned in the above-noted publication, ear-free material is obtained only through normalizing of the cold rolled strip in continuous annealing at approximately 1000 degrees Celsius, with the sheet, in its final condition, having a grain size of ASTM 8 with a relative ear height of approximately 0.3 to 0.4%, and with delta r being approximately ±0.1.

For non-normalized strip, it would be possible to achieve only a slightly eared condition, through tradeoffs in processing during the production of sheet. For this, the final rolling temperature must be approximately 750 degrees Celsius, and the cold rolling reductions must be below 25% or over 80% and it is necessary to work with recrystallization temperatures of over 600 degrees Celsius, which have been shown to be unfavorable for earing.

The above-noted publication further indicates that normalizing cannot be performed in coils but only in continuous annealling, since the strips would adhere to each other at the high temperatures.

Documents which discuss the normalization of metals are U.S. Pat. No. 4,482,397, issued on Nov. 13, 1984 to Datta-Amitava and entitled "Method for Improving the Magnetic Permeability of Grain Oriented Silicon Steel"; U.S. Pat. No. 4,428,781 issued on Jan. 31, 1984 to Norstrom and entitled "Welded Steel Chain"; U.S. Pat. No. 4,054,471, issued on Oct. 18, 1977 to Datta-Amitiva and entitled "Process for Cube-On-Edge Oriented Silicon Steel"; and U.S. Pat. No. 4,030,950 issued on Jun. 21, 1977 to Schilling et al. and entitled "Process for Cube-On-Edge Oriented Boron-Bearing Silicon Steel Including Normalizing".

In German Published Patent Application No. 32 34 574, a generic cold rolled steel sheet or strip suitable for deep drawing is described. The titanium content could reportedly go as high as 0.15%, depending on the carbon, oxygen, sulfur, and nitrogen content. The winding temperature should be over 700 degrees Celsius or at least 580 degrees Celsius, with subsequent hot rolled strip warming to more than 700 degrees Celsius. In addition, a cold rolling reduction of 70 to 85%, as well as a continuous annealing at 700 to 900 degrees Celsius with a maximum of 2 minutes holding time is called for. Information on the earing of the material is not given.

From European Patent No. A1-101 740, for a generic cold rolled steel, a slab warming temperature lower than 1100 degrees Celsius, a final rolling temperature of less than $Ar_3$, winding temperatures of 320 to 600 degrees Celsius, and a cold rolling reduction of 50 to 95%, as well as continuous recrystallization annealing, are recommended. For this, a steel with a maximum of 0.005% carbon, a maximum of 0.004% nitrogen, and a maximum of 0.02% niobium in combination with one or more of the elements aluminum, chromium, boron, or tungsten, is recommended for use. Relatively high average r-values above 1.2 are obtained. Information on the earing of the material after deep drawing is not reported.

Another process for the production of steels suitable for deep drawing, utilizing slab annealing temperatures lower than 1100 degrees Celsius, a final rolling temperature of a maximum of 780 degrees Celsius and winding temperatures of at least 450 degrees Celsius, as well as cold strip annealing in a hood type or continuous annealing furnace, is reported in European Patent No. B1-120 976. The process reportedly yields r-values near 2. Values for earing are not reported.

It is generally believed that hot rolled strip has good quasi-isotropic reformability, but has inadequate surface quality and tolerances which are too large, and, furthermore, is not produced in thicknesses less than 1.2 mm.

OBJECT OF THE INVENTION

One object of the present invention is the provision of a relatively ear-free, or at least air only slightly eared, sheet suitable for deep drawing from steel strip, and a corresponding production process, with which it is possible to do away with continuous annealing at temperatures above $A_1$, yet, however, achieving cost-effective production.

SUMMARY OF THE INVENTION

Surprisingly the present inventors have discovered that, with the use of the slab, annealing, rolling, and winding temperatures for the steels set forth herein, a recrystallization annealing of a coil in a hood type furnace suffices to provide the steel strip or the manufactured steel sheet with outstanding deep drawing properties, and in particular, an extremely low rate of earing.

It is possible, through the process according to the invention, with recrystallization annealing, to obtain lower grain size values than the usual best case value ASTM 8 of 490 $\mu m^2$ realized by the prior art, for the steel St 4 NZ or RSt 14 with normalizing. At the same time, low yield point values can be retained through the selection of appropriate cold rolling reductions, dependent upon the titanium content. Advantageously, this means that high investments for a continuous annealing installation for a normalizing treatment can be avoided.

Through variation of the titanium content within the limits indicated, it is possible to adjust for virtually any desired cold rolling reduction to an produce ear-free material, and/or, likewise, for a yield point between 175 and 450 N/mm$^2$, with tensile strength of 310 to 520 N/mm$^2$.

It is believed that one of the reasons for the favorable properties of the sheet produced is found in the early formation of titanium nitride, which, it is believed, prevents a pancake structure from developing during the recrystallization annealing through aluminum nitride precipitations.

Surprisingly, through the selection of low winding temperatures of around 520 degrees Celsius, hot rolled strip qualities were obtained which apparently guaranteed the production of ear-free material after cold rolling and permitted additional grain refinement.

A particular advantage of the hot rolled strip produced in this manner is that, in principle, there is apparently no restriction whatsoever with regard to the subsequent cold rolling, so long as the cold rolling reduction is at least 5%, i.e., so long as the cold rolling reduction remains above the known critical weak cold working which leads to excessively coarse grain size with recrystallization annealing. It is believed that, previously, only specific cold rolling reductions could be used in the production of nearly, or very nearly, ear-free cold rolled strip, unless normalizing was to take place.

It is believed that the present inventors have discovered that, surprisingly, in fact a certain titanium content is desirable to perform the process according to the invention and to obtain material properties according to the invention, but these process parameters should then be adapted, at least relative to the cold rolling reduction, when the element niobium is added to the alloy to improve strength.

The variation of the cold rolling reduction as a function of the amount of titanium in the alloy is believed to be limited to cold rolling reductions from 45 to 85% when niobium is added within the limits set forth herein.

The addition of niobium is believed to not impede the early formation of titanium nitride, so that, again, with this steel alloy according to the invention, a pancake structure is perceived as not developing during recrystallization annealing.

It is believed that an important technical and economic aspect of the invention consists in the use of the thin sheet for rotationally symmetric deep drawn parts such as needle bearing cups, split belt pulleys, etc. A sheet, according to the invention, can be used in these cases without a substantial dressing, such as the removal of ears. In deep drawing, the low rate of earing is perceived as also preventing the development of thin zones in walls, so that the drawn parts are not substantially out of balance during the rotation thereof. Additional advantages of slightly eared or ear-free cold rolled strip are well known in the pertinent art, so that further description is superfluous.

The following exemplary embodiments will illustrate the results of the process conducted according to the present invention.

One aspect of the invention resides broadly in a process for the production of a cold rolled steel product, the process comprising the steps of:

producing a melt, the melt comprising the following, by weight percentages:

| | |
|---|---|
| max. 0.10 | % carbon; |

-continued

| | |
|---|---|
| max. 0.40 | % silicon; |
| 0.10 to 1.0 | % manganese; |
| max. 0.08 | % phosphorus; |
| max. 0.02 | % sulfur; |
| max. 0.009 | % nitrogen; |
| 0.015 to 0.08 | % aluminum; |
| 0.01 to 0.04 | % titanium; and |
| max. 0.15 | % of one or more of the elements from the group copper, vanadium, nickel; |

with the remainder being iron and unavoidable impurities;

forming the melt into a slab;

heating the slab to a temperature above about 1120° C.;

rolling the slab at a final rolling temperature above $Ar_3$;

winding the product at a temperature of about 520° C.±100° C.;

cold rolling the product; and recrystallization annealing the product, the recrystallization annealing step being carried out on the product in a coiled form.

Alternatively the melt may have an additional amount of 0,01 to 0,06% niobium.

Another aspect of the invention resides broadly in a process for the production of a cold rolled steel product, the process comprising the steps of:

producing a melt, the melt having the following composition, in weight percentages:

| | |
|---|---|
| max. 0.10 | % carbon; |
| max. 0.40 | % silicon; |
| 0.10 to 1.0 | % manganese; |
| max. 0.08 | % phosphorus; |
| max. 0.02 | % sulfur; |
| max. 0.009 | % nitrogen; |
| 0.015 to 0.08 | % aluminum; |
| 0.01 to 0.04 | % titanium; and |
| max. 0.15 | % of one or more of the elements from the group copper, vanadium, nickel; |

with the remainder being iron and unavoidable impurities;

producing a slab from the melt;

heating the slab to a temperature of above 1120° C.;

rolling the product into a hot rolled strip at a final rolling temperature above $Ar_3$;

winding the product at a temperature of 520° C.±100° C.;

cold rolling the product with a rate of reduction (epsilon) achieved during the cold rolling step being dependent upon the titanium content of the melt, as follows:

wherein the melt contains about 0.01% titanium, the rate of reduction (epsilon) achieved is about 20% about 60%;

wherein the melt contains about 0,02% titanium, the rate of reduction (epsilon) achieved is at least one of about 5% to about 20% and about 40% to about 85%;

wherein the melt contains about 0.03% titanium, the rate of reduction (epsilon) achieved is at least one of about 5% to about 25% and about 50% to about 85%; and wherein the melt contains about 0.04% titanium, the rate of reduction (epsilon) achieved is at least one of about 15% to about 25% and about 55% to about 80%;

recrystallization annealing the product at a temperature below $A_1$, the recrystallization step being carried out with the product in a coiled configuration; and dressing the product at a reduction rate of about 1%.

Yet another aspect of the invention resides broadly in a cold rolled steel product particularly suited for deep drawing, the cold rolled steel product being produced according to a process for the production of a cold rolled steel product, the process comprising the steps of:

producing a melt, the melt comprising the following, by weight percentages:

| | |
|---|---|
| 0.03 to 0.08 | % carbon; |
| max. 0.40 | % silicon; |
| 0.10 to 1.0 | % manganese; |
| max. 0.08 | % phosphorus; |
| max. 0.02 | % sulfur; |
| max. 0.009 | % nitrogen; |
| 0.015 to 0.08 | % aluminum; |
| 0.01 to 0.04 | % titanium; and |
| max. 0.15 | % of one or more of the elements from the group copper, vanadium, nickel; |

with the remainder being iron and unavoidable impurities;

forming the melt into a slab;

heating the slab to a temperature above about 1120° C.;

rolling the slab at a final rolling temperature above $Ar_3$;

winding the product at a temperature of about 520° C.±100° C.;

cold rolling the product; and recrystallization annealing the product, the recrystallization annealing step being carried out on the product in a coiled form;

wherein the cold rolled steel product has a recrystallized texture with a ferritic grain size which is at least one of the following:

a ferritic grain size finer than ASTM 7, when the melt has a titanium content of about 0.01%; and a ferritic grain size finer than ASTM 9, when the melt has a titanium content of about 0.015% to about 0.04%.

Alternatively the melt may have an additional amount of 0.01 to 0.06% niobium.

A further aspect of the invention resides broadly in a cold rolled steel product particularly well for deep drawing, the cold rolled steel product being produced according to a process for the production of a cold rolled steel product, the process comprising the steps of:

producing a melt, the melt having the following composition, in weight percentages:

| | |
|---|---|
| 0.03 to 0.08 | % carbon; |
| max. 0.40 | % silicon; |
| 0.10 to 1.0 | % manganese; |
| max. 0.08 | % phosphorus; |
| max. 0.02 | % sulfur; |
| max. 0.009 | % nitrogen; |
| 0.015 to 0.08 | % aluminum; |
| 0.01 to 0.04 | % titanium; and |
| max. 0.15 | % of one or more of the elements from the group copper, vanadium, nickel; |

with the remainder being iron and unavoidable impurities;

producing a slab from the melt;

heating the slab to a temperature of above 1120° C.;

rolling the product into a hot rolled strip at a final rolling temperature above $Ar_3$;

winding the product at a temperature of 520° C.±100° C.;

cold rolling the product, the rate of reduction (epsilon) achieved during the cold rolling step being dependent upon the titanium content of the melt, as follows:

wherein the melt contains about 0.01% titanium, the rate of reduction (epsilon) achieved is about 20% to about 60%;

wherein the melt contains about 0.02% titanium, the rate of reduction (epsilon) achieved is at least one of about 5% to about 20% and about 40% to about 85%;

wherein the melt contains about 0.03% titanium, the rate of reduction (epsilon) achieved is at least one of about 5% to about 25% and about 50% to about 85%; and wherein the melt contains about 0.04% titanium, the rate of reduction (epsilon) achieved is at least of about 15% to about 25% and about 55% to about 80%;

recrystallization annealing the product at a temperature below $A_1$, the recrystallization step being carried out with the product in a coiled configuration; and dressing the product at a reduction rate of about 1%;

wherein the cold rolled steel product has a recrystallized structure with a ferritic grain size which is at least one of the following:

a ferritic grain size finer than ASTM 7, when the melt has a titanium content of about 0.01%; and a ferritic grain size finer than ASTM 9, when the melt has a titanium content of about 0.015% to about 0.04%.

A yet further aspect of the invention resides broadly in a rotationally symmetrical, substantially ear-free, deep drawn steel part produced from a cold rolled steel product particularly well for deep drawing, the cold rolled steel product being produced according to a process for the production of a cold rolled steel product, the process comprising the steps of:

producing a melt, the melt having the following composition, in weight percentages:

| | |
|---|---|
| 0.03 to 0.08 | % carbon; |
| max. 0.40 | % silicon; |
| 0.10 to 1.0 | % manganese; |
| max. 0.08 | % phosphorus; |
| max. 0.02 | % sulfur; |
| max. 0.009 | % nitrogen; |
| 0.015 to 0.08 | % aluminum; |
| 0.01 to 0.04 | % titanium; and |
| max. 0.15 | % of one or more of the elements from the group copper, vanadium, nickel; |

with the remainder being iron and unavoidable impurities;

producing a slab from the melt;

heating the slab to a temperature of about 1120° C.;

rolling the product into a hot rolled strip at a final rolling temperature above $Ar_3$;

winding the product at a temperature of 520° C.±100° C.;

cold rolling the product, the rate of reduction (epsilon) achieved during the cold rolling step being dependent upon the titanium content of the melt, as follows:

wherein the melt contains about 0.01% titanium, the rate of reduction (epsilon) achieved is about 30% to about 50%;

wherein the melt contains about 0.02% titanium, the rate of reduction (epsilon) achieved is at least one of about 10% to about 15% and about 50% to about 80%;

wherein the melt contains about 0.03% titanium, the rate of reduction (epsilon) achieved is at least one of about 10% to about 20% and about 60% to about 80%; and wherein the melt contains about 0.04% titanium, the rate of reduction (epsilon) achieved is at least one of about 20% and about 60% to about 70%;

recrystallization annealing the product at a temperature below $A_1$, the recrystallization step being carried out with the product in a coiled configuration; and dressing the product at a reduction rate of about 1%;

wherein the cold rolled steel product has a recrystallized structure with a ferritic grain size which is at least one of the following:

a ferritic grain size finer than ASTM 7, when the melt has a titanium content of about 0.01%; and a ferritic grain size finer than ASTM 9, when the melt has a titanium content of about 0.015% to about 0.04%;

wherein the titanium content of the melt is substantially at least 3.5 times the nitrogen content of the melt;

wherein the rate of reduction (epsilon) achieved during the cold rolling step is dependent upon the titanium content of the melt. If alternatively an additional amount of 0.01 to 0.06% niobium is added to the melt in all aspects of the invention the cold rolling step is limited with respect to the rate of reduction (epsilon) being dependent upon the titanium content of the melt, as follows:

wherein the titanium content of the melt is about 0.01%, the rate of reduction (epsilon) achieved is about 45% through about 85%;

wherein the titanium content of the melt is about 0.02%, the rate of reduction (epsilon) achieved is about 55% through about 85%; and wherein the titanium content of the melt is about 0.03%, the rate of reduction (epsilon) achieved is about 60% through about 70%.

DESCRIPTION OF PREFERRED EMBODIMENTS

Slabs 210 mm thick were cast in billets from conducted melts A and D according to the invention, and from the reference melts E through F. The compositions of the studs used are set forth in FIGS. 1*a*-1*c*. After heating in a so-called "pusher furnace" to a temperature of 1250 degrees Celsius, the resulting slab was rolled into a hot rolled strip 3 mm thick, which was then wound, and, thereafter, cooled to room temperature. The final rolling temperatures and winding temperatures are shown in Table 2. After a pickling process, the strips were then reduced by cold rolling in various steps from 10% to 80% to thin sheet thicknesses. The resulting product was then again wound. The resulting coil was then heated in a box annealing furnace, from the company Ludwig, to 700 degrees Celsius, recrystallization annealed with a throughout of 1.1 t/h to 1.9 t/h, and then cooled in the furnace to 120 degrees Celsius. After a dressing with reforming reductions of from about 1 to 1.2%, the strip was then cut into plates.

Circular blanks 90 or 180 mm is diameter were thereafter deep drawn with drawing punches, 50 or 100 mm in diameter, at clamping forces of about 50 kN to form cups. The cups so formed are shown in FIGS. 2*a*-9 and 13-18.

Figure 1A:
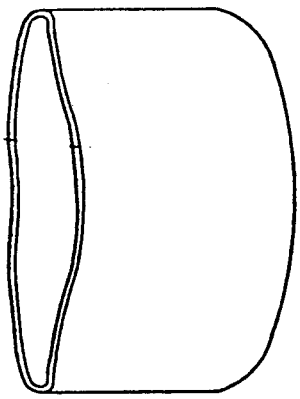
FIGS. 1(A-C) are diagrams illustrating three different degrees of ear formation on a deep drawn cup.
Figure 1B:
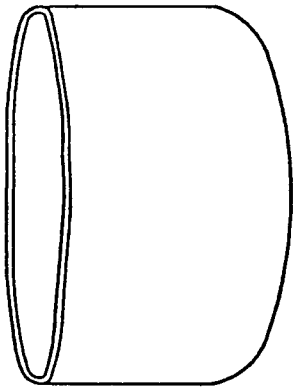
Figure 1C:
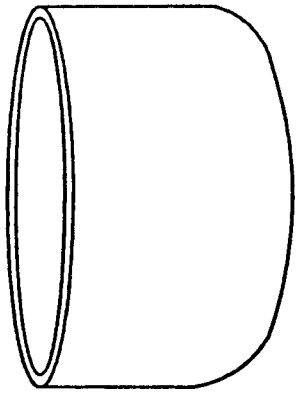
Figure 3:
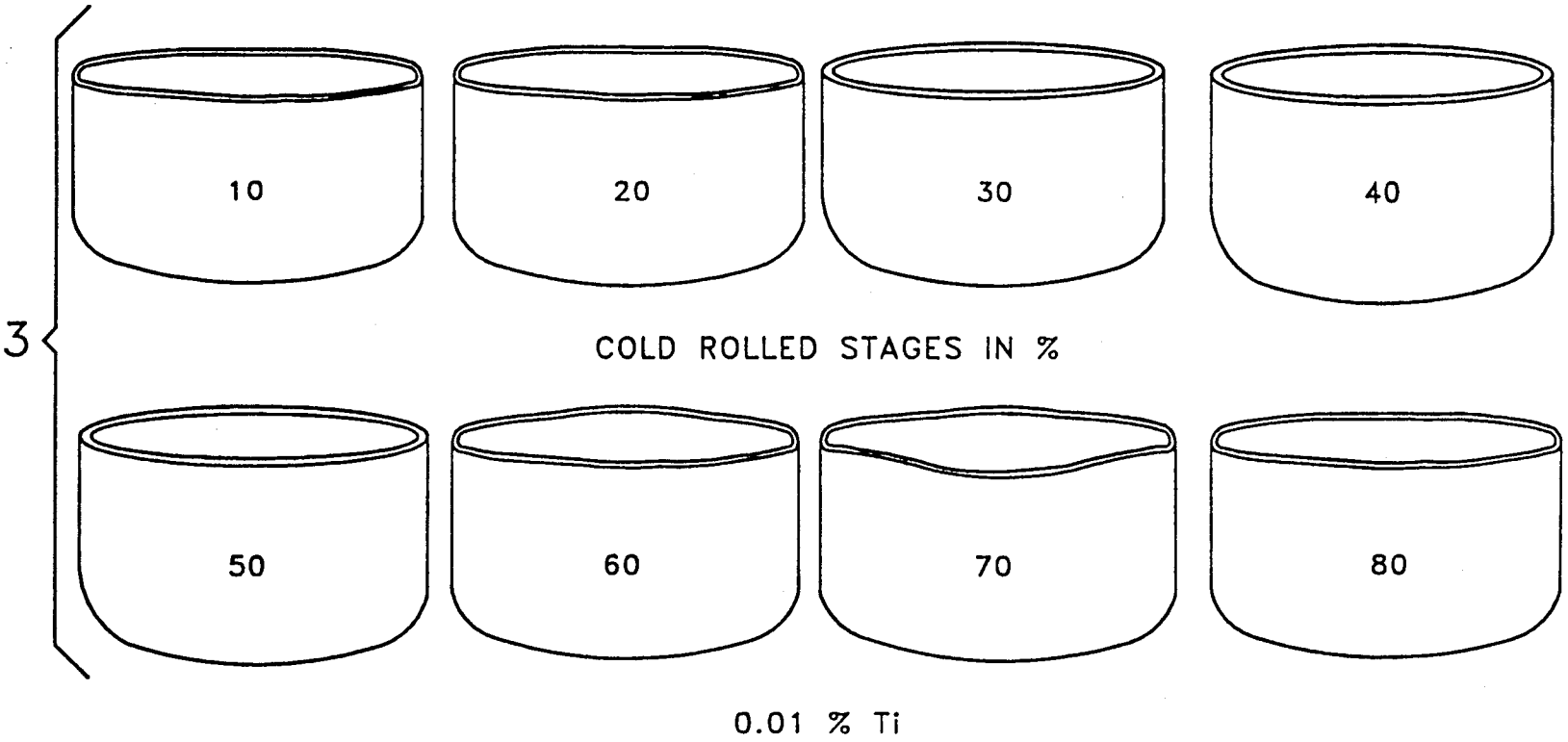
Figure 4:
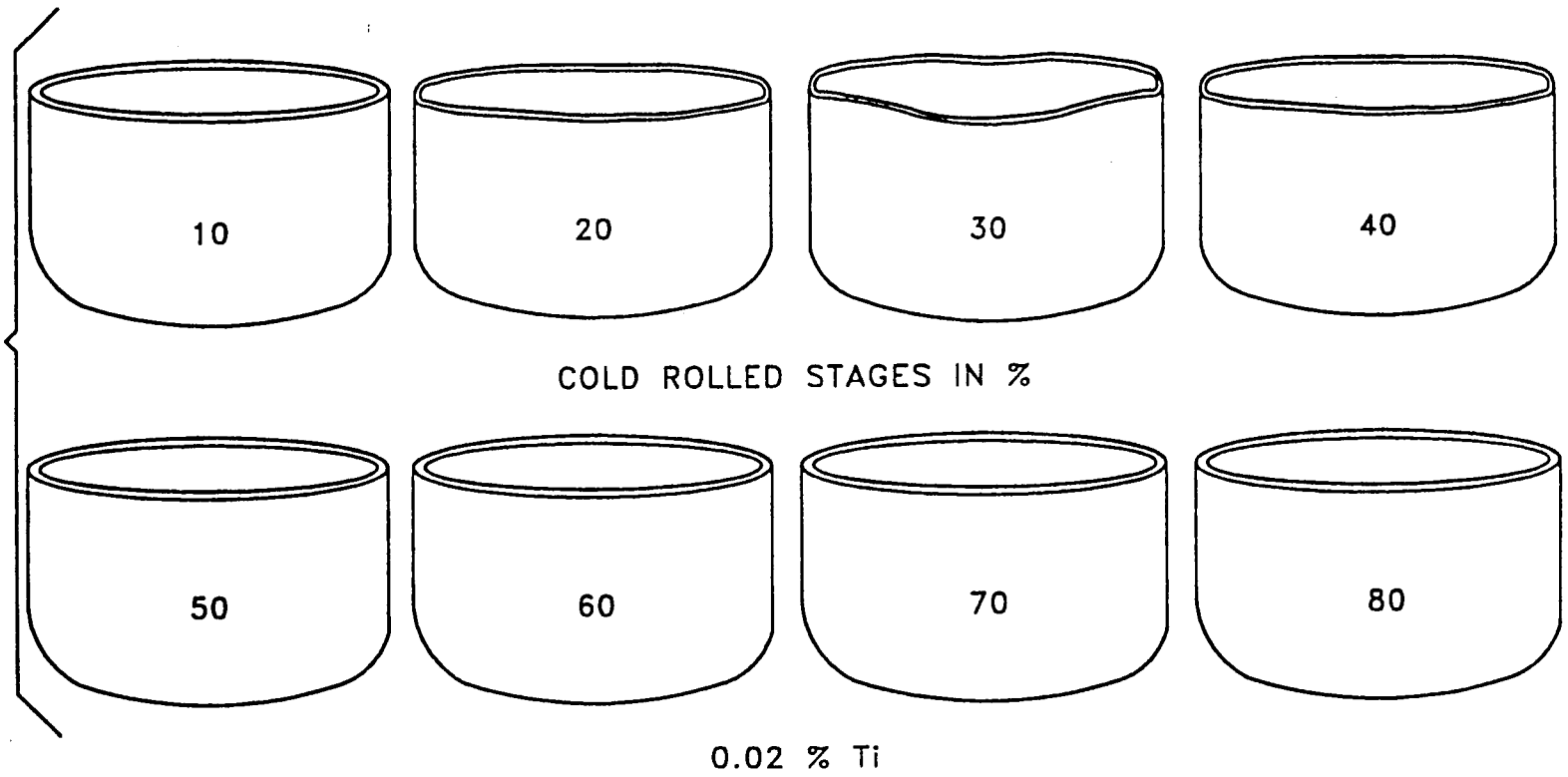
Figure 5:
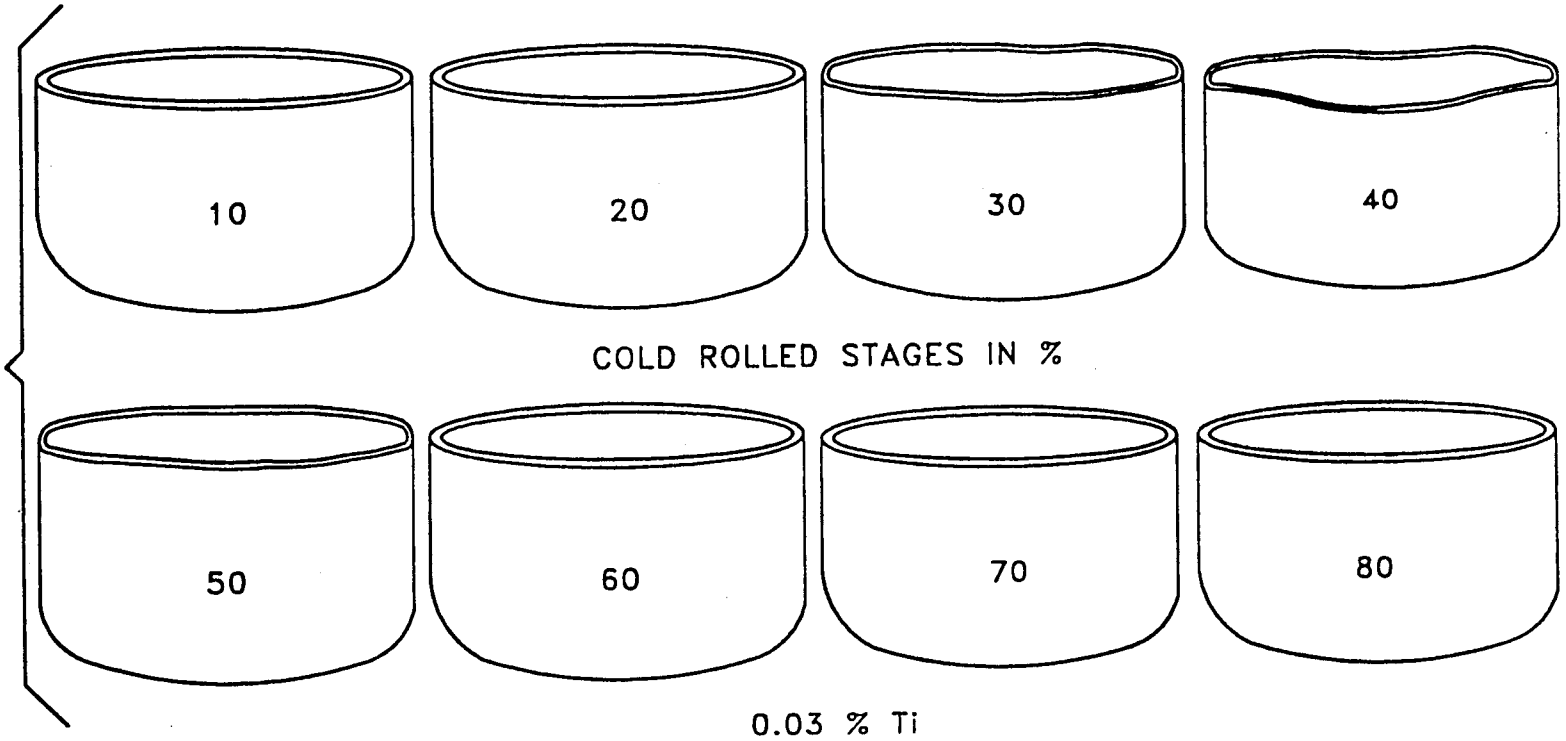
Figure 6:
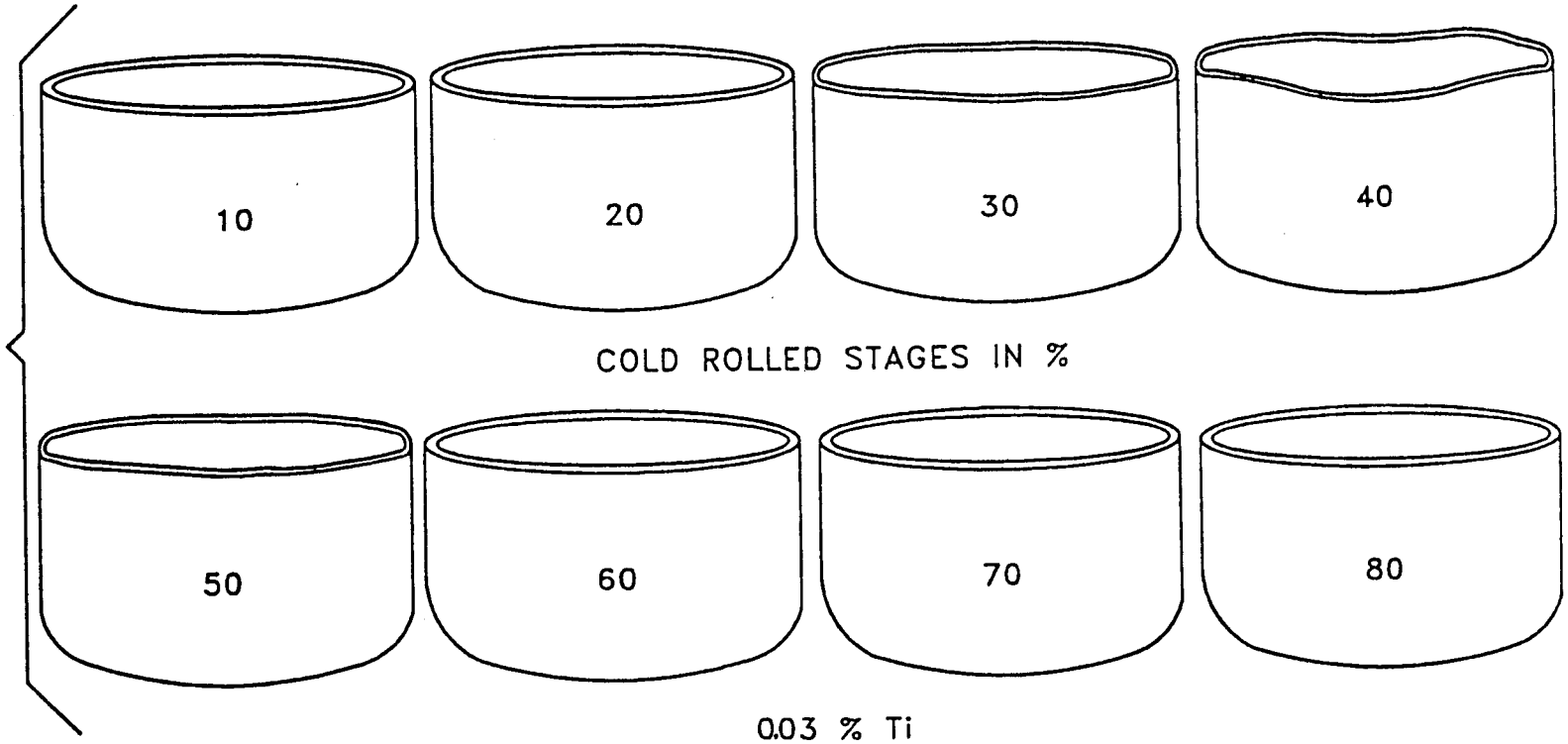
Figure 7:
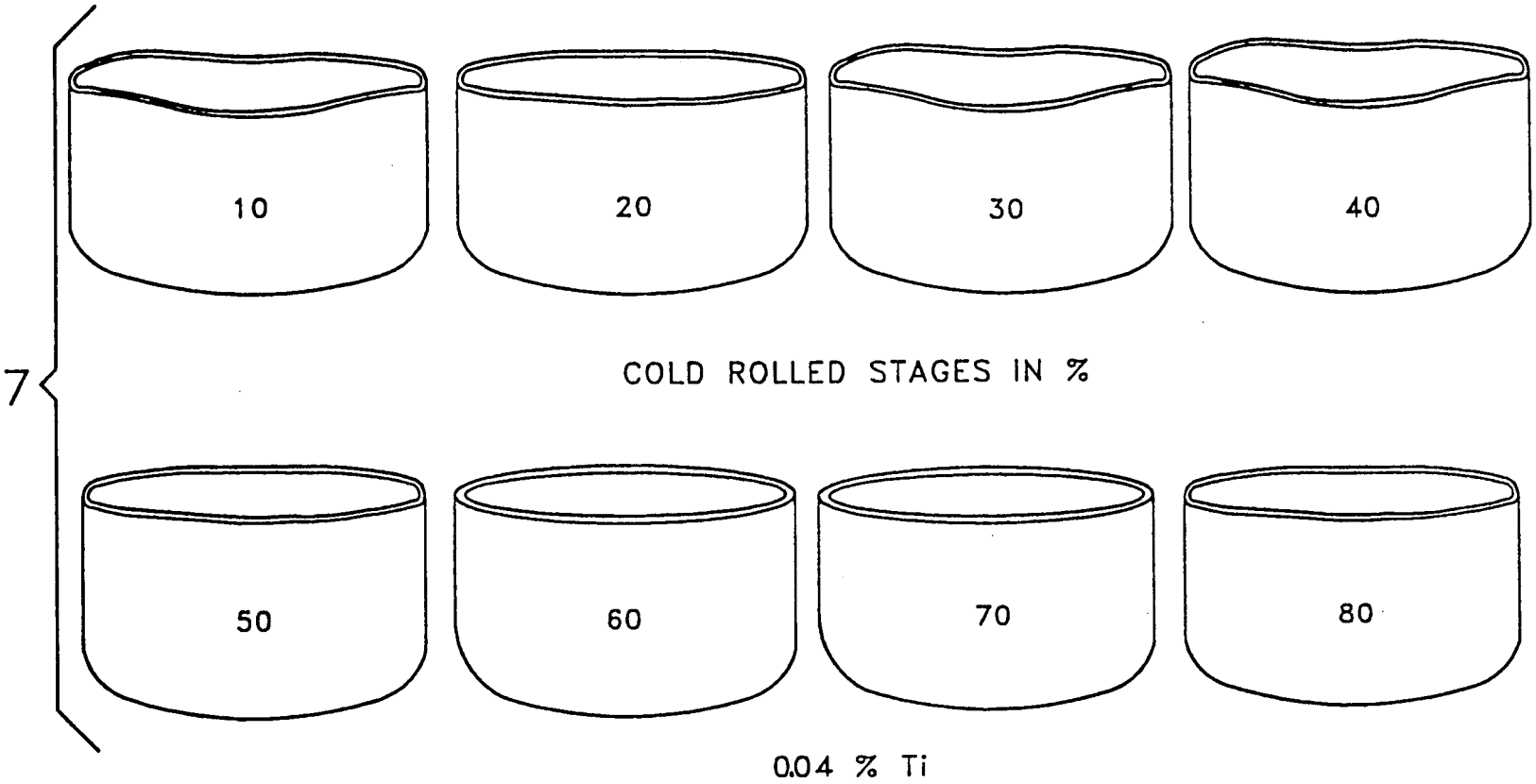

FIGS. 1*a*-1*c* illustrates three different cups which serve to define the terms used herein: eared (FIG. 1*a*); slightly eared (FIG. 1*b*); and ear-free (FIG. 1*c*). Since measurement of ear height with commercially available ear measurement devices, especially the measurement of slightly eared and substantially ear-free cups with slight differences in height, even with the smallest deep drawn ears, the measurement of burrs on the rim of the cup is problematic.

Figure 10A:
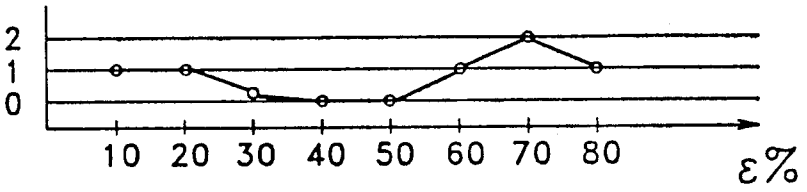
FIGS. 10*a*-12*d* are charts which relate the ear formation to the degree of cold rolling reduction for the various steels.
Figure 10B:
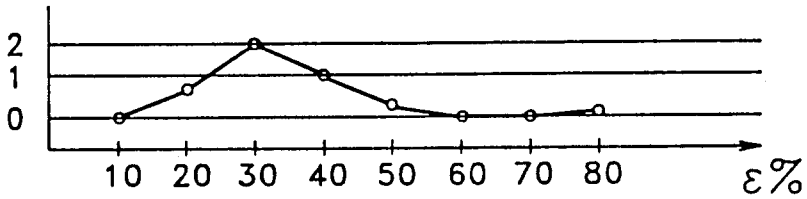
Figure 10C:
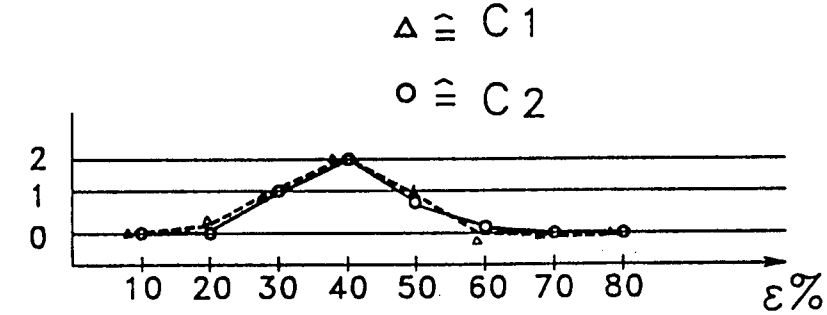
Figures 10D, 10E, 10F:
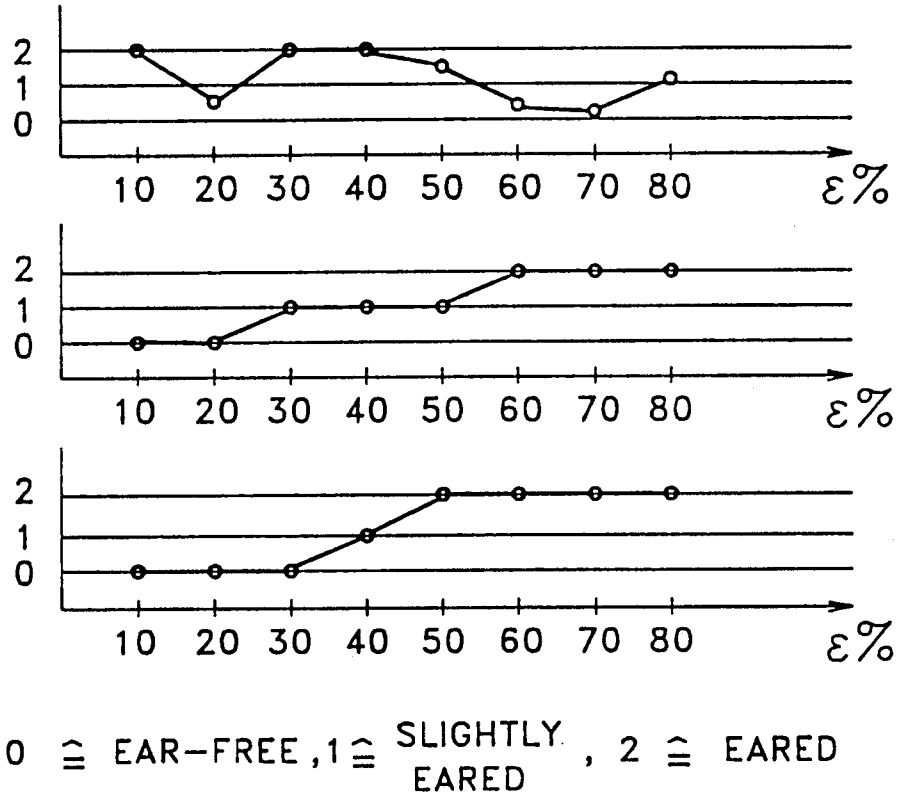

This definition was adopted for FIGS. 10*a*-10*f*, for the representation of the degree of earing on cups from the various melts. FIG. 10*a* represents melt, steel or alloy composition A. FIG. 10B represents melt, steel or composition B. FIG. 10C represents melt, steel or alloy composition C, FIG. 10*d* represents melt, steel or alloy composition D, FIG. 10*e* represents melt, steel or alloy composition D. FIG. 10*e* represents melt, steel or alloy composition E. FIG. 10*f* represents melt, steel or alloy composition F. It was discovered by the present inventors that the steel E wound at 710 degrees Celsius is relative ear-free, substantially only at cold rolling reductions less than 25% and, more particularly, in the range from 30-50%, the reduction can at best be described as slightly eared. For the reference steel F employed, which was wound according to the prior art, at 500 degrees Celsius, earing was noted at reductions greater than about 30%.

Figure 8:
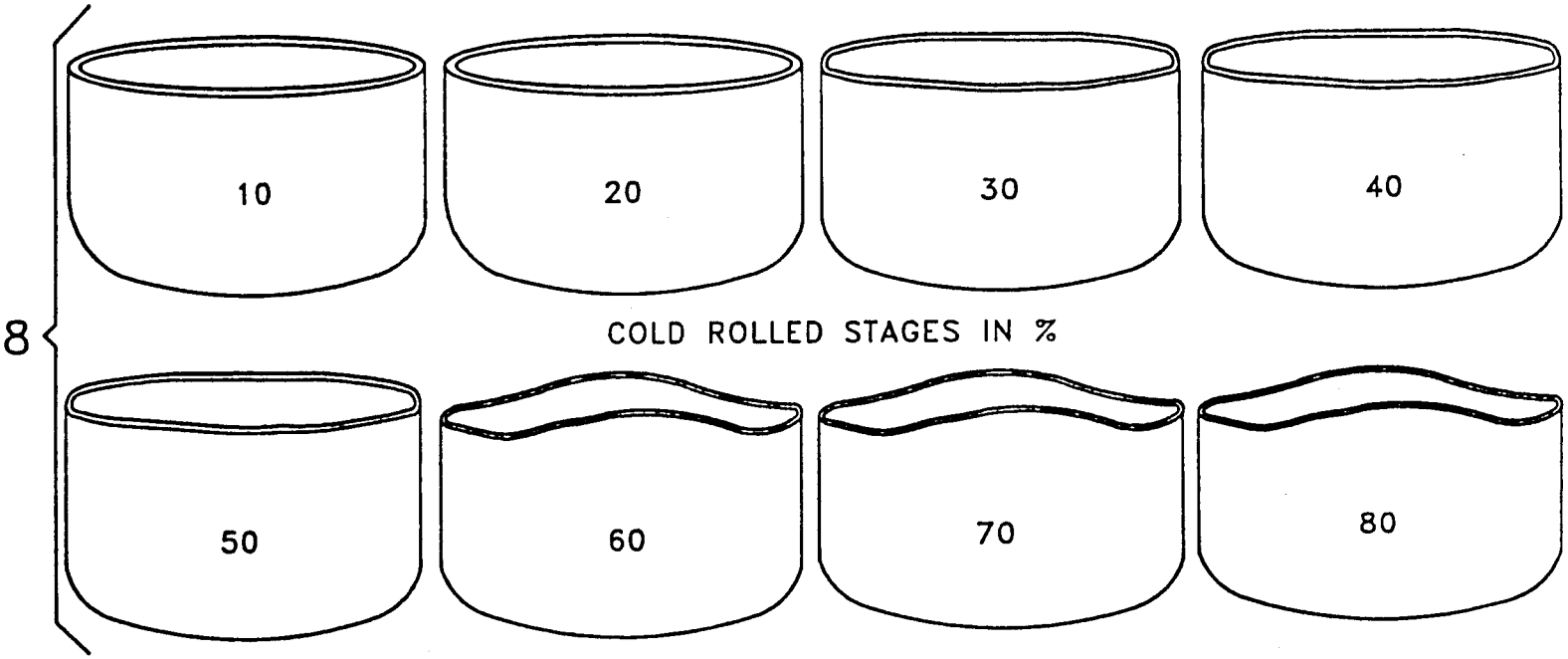
Figure 9:
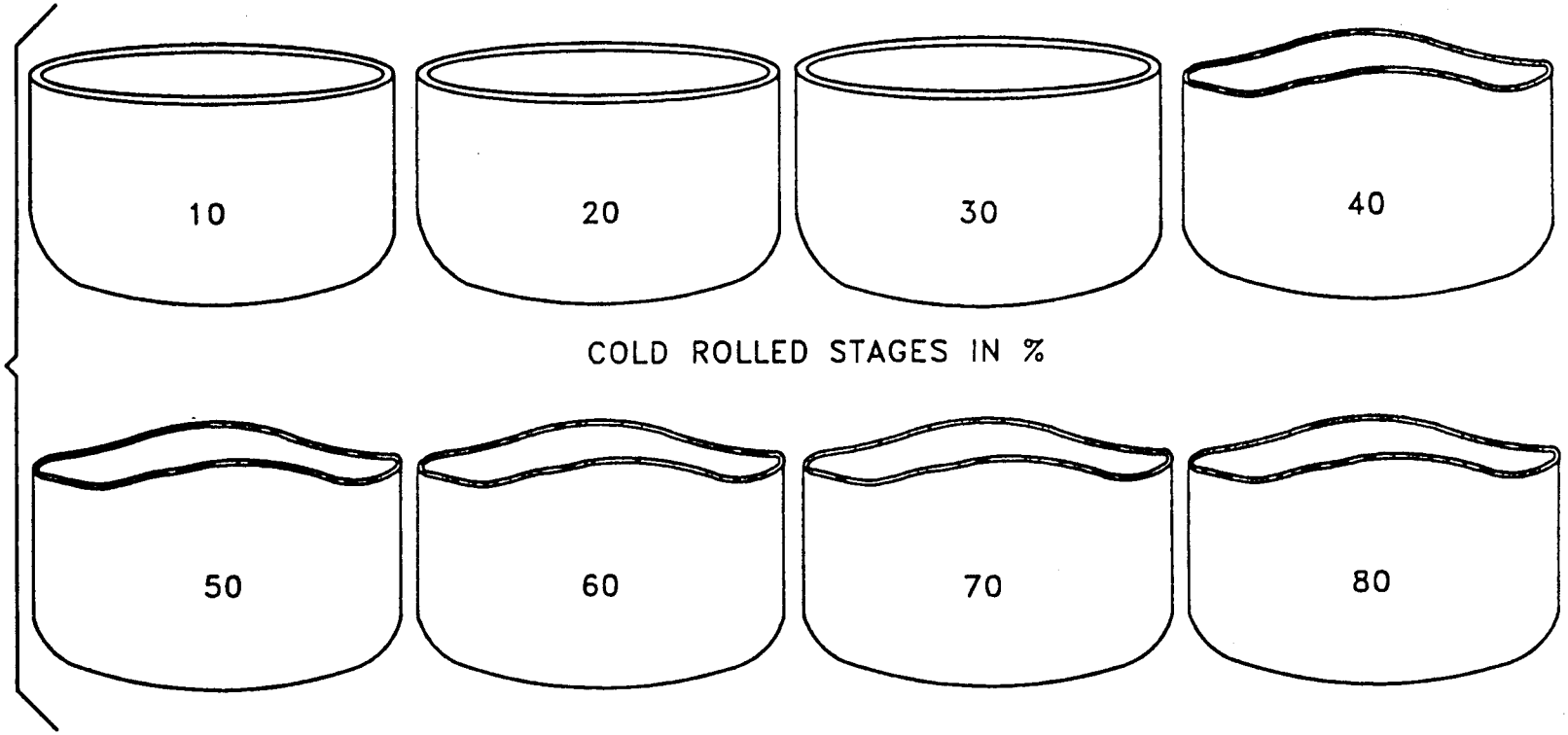

The diagrams presented in FIGS. 8 and 9 demonstrate this aspect of the invention impressively.

With the use of the steels A through D, rolled and annealed according to the process of the invention, the cups presented a different deep drawing result at various reductions, depending on the titanium content. This aspect and advantage of the invention is illustrated by the following Quantitative Examples:

Quantitative Examples

Steel A containing 0.01% Ti:

The cups were absolutely ear-free at reductions of epsilon=30-50%, whereas reductions of 20% or 60% permitted only slightly eared drawing of the cups.

Steel B with 0.02% Ti: Ear-free at epsilon=10%, as well as at 50-80%

Steel B was slightly eared at epsilon=20%; 40%

Steels C1/C2 with 0.03% Ti, where C1 wound at 500 degrees Celsius, and where $C_2$ was wound at 450 degrees Celsius:

Ear-free at epsilon=10-20% as well as 60-80%

Slightly eared at epsilon=30%; 50%

Steel D with 0.04% Ti:

Ear-free at epsilon=60-70% or 20%

Slightly eared at epsilon=15%; 25%; 55%; 80%

Observations

From the comparison of the curves for the steels A through D, trends are observed which lead the present inventors to the expectation of relatively ear-free deep drawing of cups for intermediate values of the alloying element, 0.025% Ti, for example, for steel B, with cold rolling reductions up to 15% or 20% and up to 85%, i.e., a shift of the curve toward the right. On the other hand, with values between 0.01% and 0.02% a shift of the "ear-free" cold rolling reduction to inferior reforming conditions can be inferred.

The diagrams of the deep drawn cups illustrated in FIGS. 3 through 7, corresponding to the steels according to FIGS. 10*a*–10*f* and Tables 1 and 2, clearly show the result.

Figure 11:
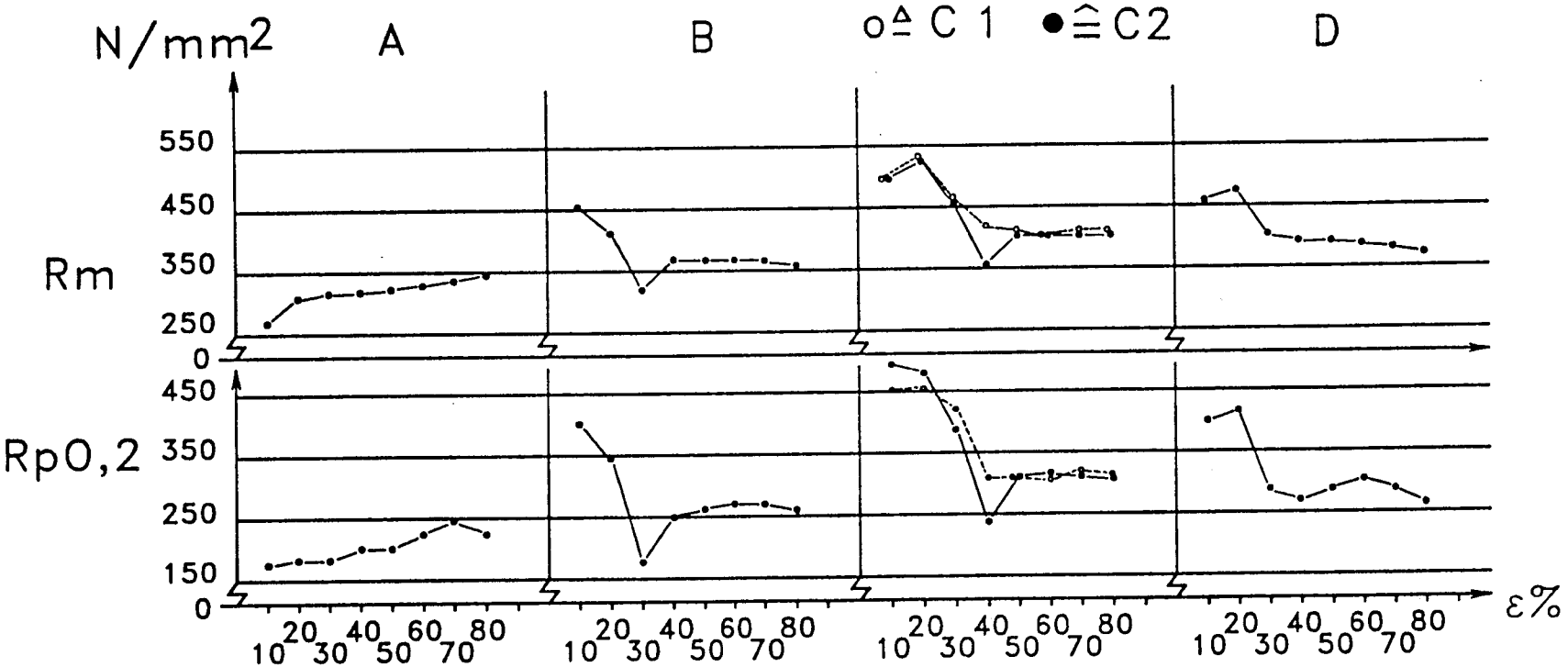

Surprisingly, it turned out that the relatively "ear-free" reforming reduction rates could, in each case, be associated with a specific tensile strength and a particular yield point level. These relationships are set forth in FIG. 11. Additionally, the greatest earing was, at the same time, observed with the lowest yield point/tensile strength.

EXAMPLE

Steel B a. Absence of earing at cold rolling reductions 10%–15% t

Yield point level $R_{p0.2}$=400–350 N/mm$^2$

Tensile strength level $R_m$=450–400 N/mm$^2$ b. Earing at cold rolling reductions 30% t $R_{p0.2}$=180 N/mm$^2$ and $R_m$=320 N/mm$^2$ c. Absence of earing at cold rolling reductions 50–80% t $R_{p0.2}$=250–280 N/mm$^2$ and Rm=360–370 N/mm$^2$ These findings make possible component or function-specific selection of tensile strength for any one component, through the variations of the parameters of the titanium content and the cold rolling reduction.

Figure 12A:
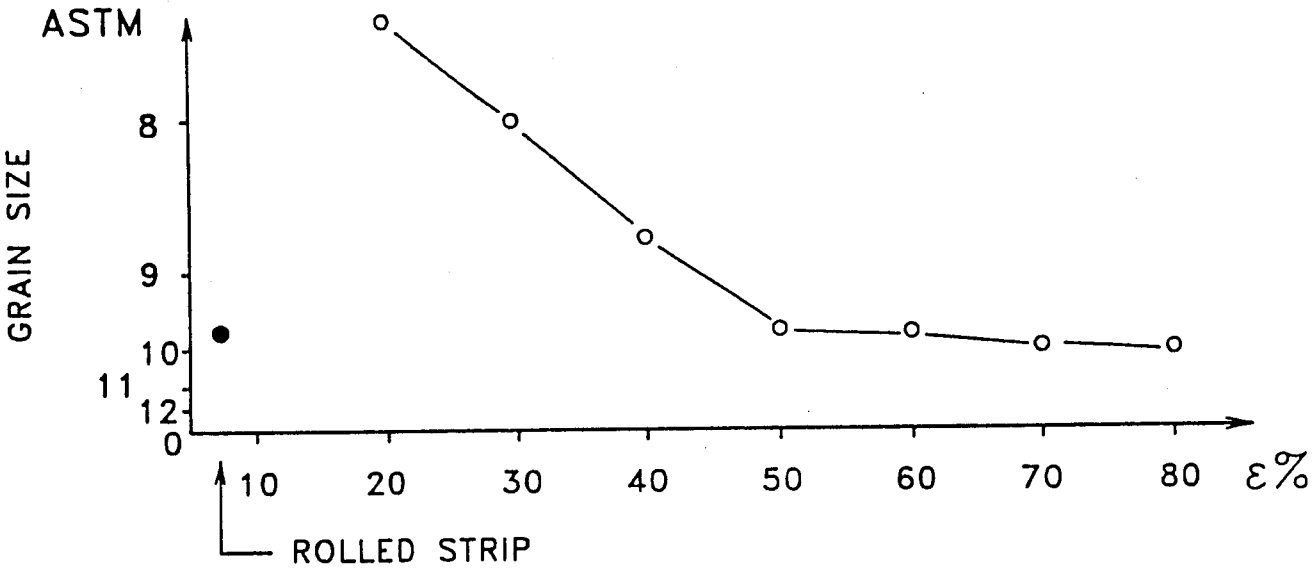
Figure 12B:
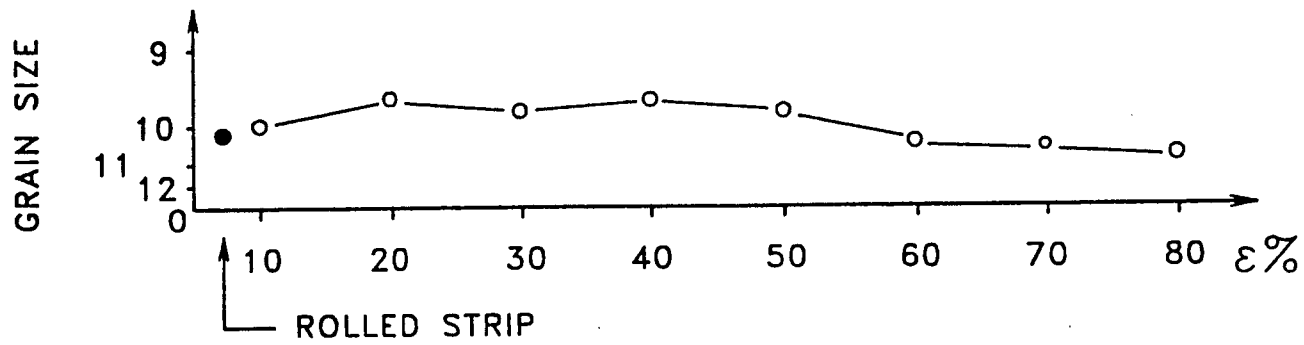
Figure 12C:
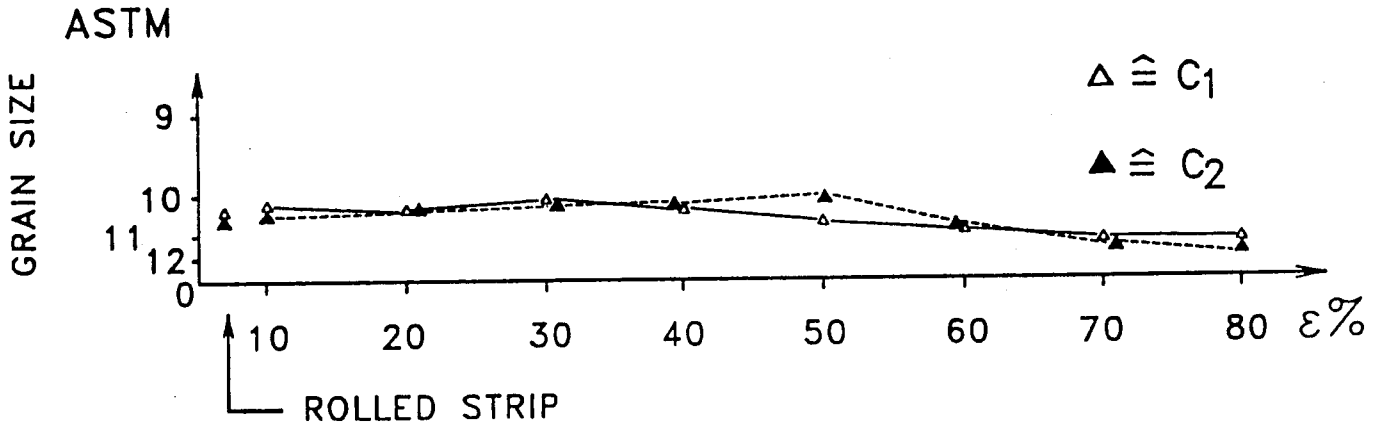
Figure 12D:
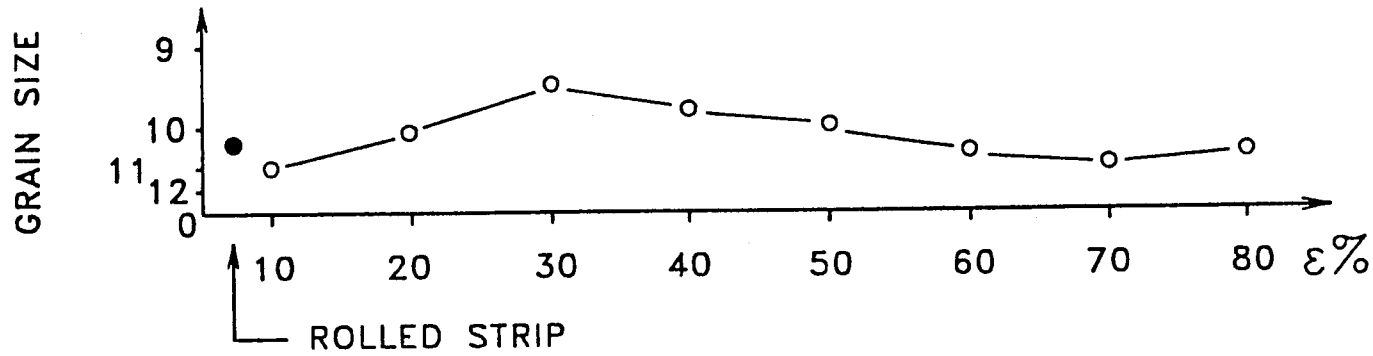

Table 2 sets forth the grain size obtained, according to the invention, corresponding to FIGS. 12*a*–12*d*. FIG. 12*a* corresponds to melt, steel, or alloy composition A, FIG. 12*b* corresponds to melt, steel or alloy composition B. FIG. 12*c* corresponds to melt, steel or alloy composition C. FIG. 12*d* corresponds to melt, steel or alloy composition D. The grain refinement obtainable compared to steels without the addition of titanium, that is, according to the prior art, is significant and extends to ASTM 11.

The coarsest grain was obtained with a low Ti-content and with a low cold rolling reduction (ASTM 7). By way of comparison, the hot rolled strip values for grain size (ASTM 9–10), with steels A through D are included in FIGS. 12*a*–*d*.

For the steel C (variants C3–C5), tests were performed with a variable winding temperature Th, and with an annealing throughput Pg, the results of which are illustrated in Table 3. Whereas the variations in the throughput quantity of a hood type annealing furnace of 1.1–1.9 t/h did not have a negative effect on either the grain size or on the planar anisotropy (delta r), an increase in the winding temperature to 710 degrees Celsius with virtually the same final rolling temperatures resulted in a coarser grain size and a deterioration of the planar anisotropy.

Figure 2A:
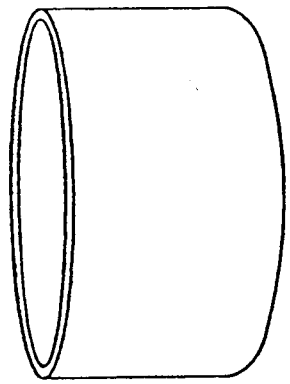
FIGS. 2*a*-9 and 13-18 are diagrams showing deep drawn steel cups formed of particular alloys which have been subjected to various progressive degrees of cold rolling reduction.
Figure 2B:
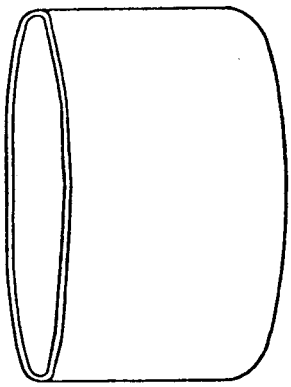
Figure 2C:
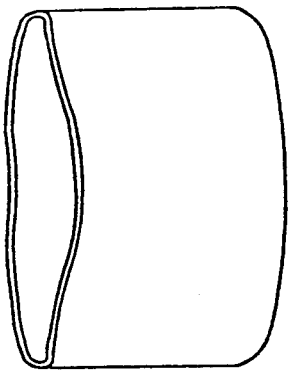

FIGS. 2*a*, 2*b*, 2*c* illustrate the corresponding results derived from cups formed from 180-mm circular blanks which were deep drawn with 100-mm punches at a 50 kN clamping force.

Table 1 also lists the melt compositions of the steel G with 0.01% titanium, the steel H with 0.02% titanium, and the steel I with 0.03% titanium and with 0.05% or 0.06% niobium according to the invention. Also listed is a reference steel K, with 0.05% niobium but without titanium. Slabs 220 mm thick were cast in billets from the melts G through I, according to the invention, as well as from the reference melt K. After heating in a pusher furnace to 1250 degrees Celsius, the slab was rolled into hot rolled strip 4 mm thick, wound, and then cooled to room temperature. The final rolling temperature as 880 degrees, Celsius and the winding temperature was 510 degrees Celsius. After pickling, the strips were reduced by cold rolling in various steps from 10% to 80% to thin sheet thicknesses and then again wound. After winding, the tightly-wound coil was heated in a box annealing furnace, from the company Ludwig, to 700 degrees Celsius, recrystallization annealed with throughput rates of 1.1 t/h to 1.8 metric tons per hour, and then cooled in the box annealing furnace to 120 degrees Celsius. After dressing with a reforming reduction of 1.1%, the strip was thereafter cut into plates. Circular blanks 90 mm in diameter were deep drawn with drawing punches 50 mm in diameter to form the cups illustrated in FIGS. 13 through 16.

Figure 16:
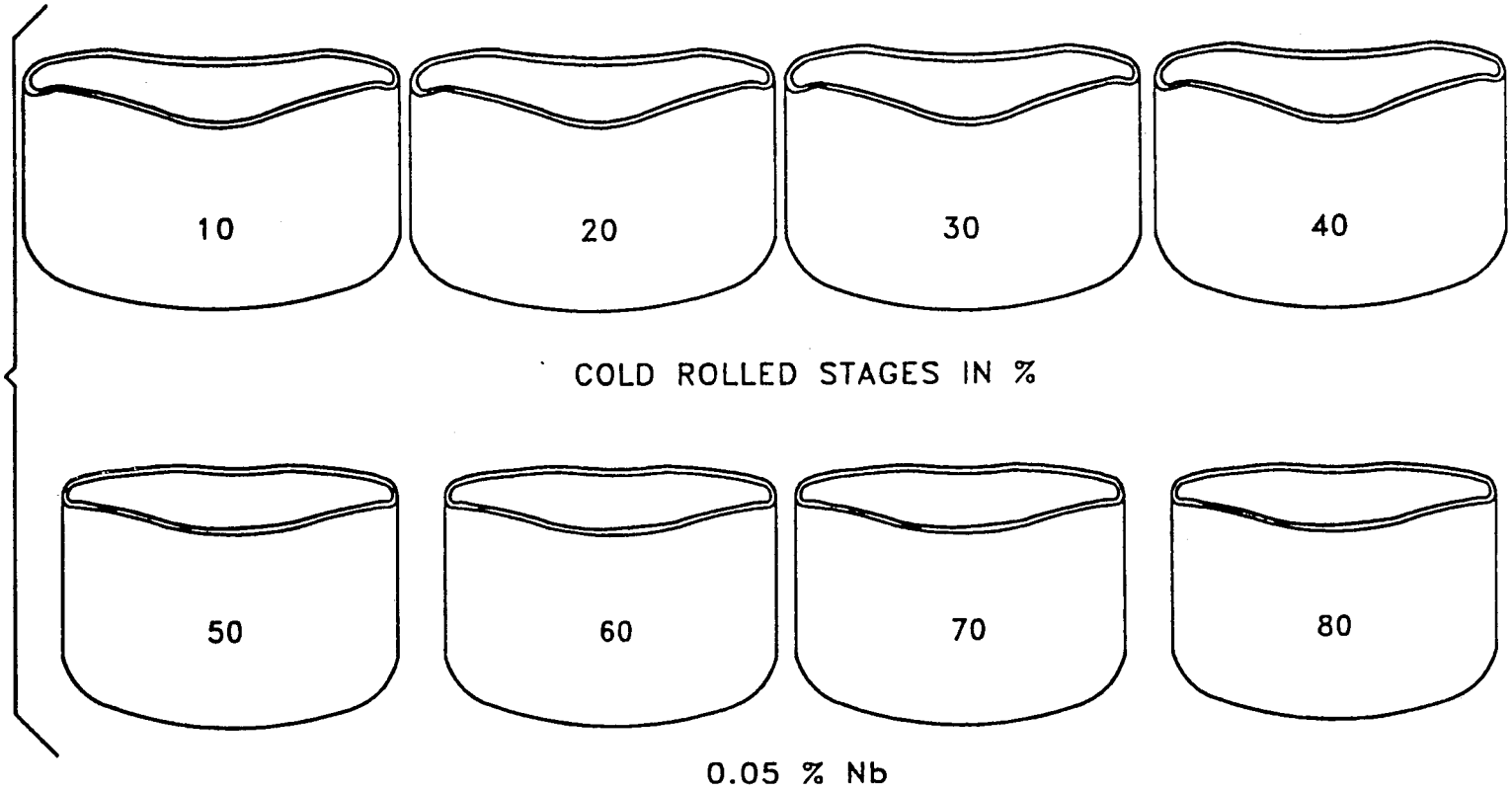

For the reference steel K, which contained no titanium in the alloy, but which rather belonged to a generic steel type, FIG. 16 clearly shows that ear-free deep drawing was not possible at any of the cold rolling reductions tested.

Figure 13:
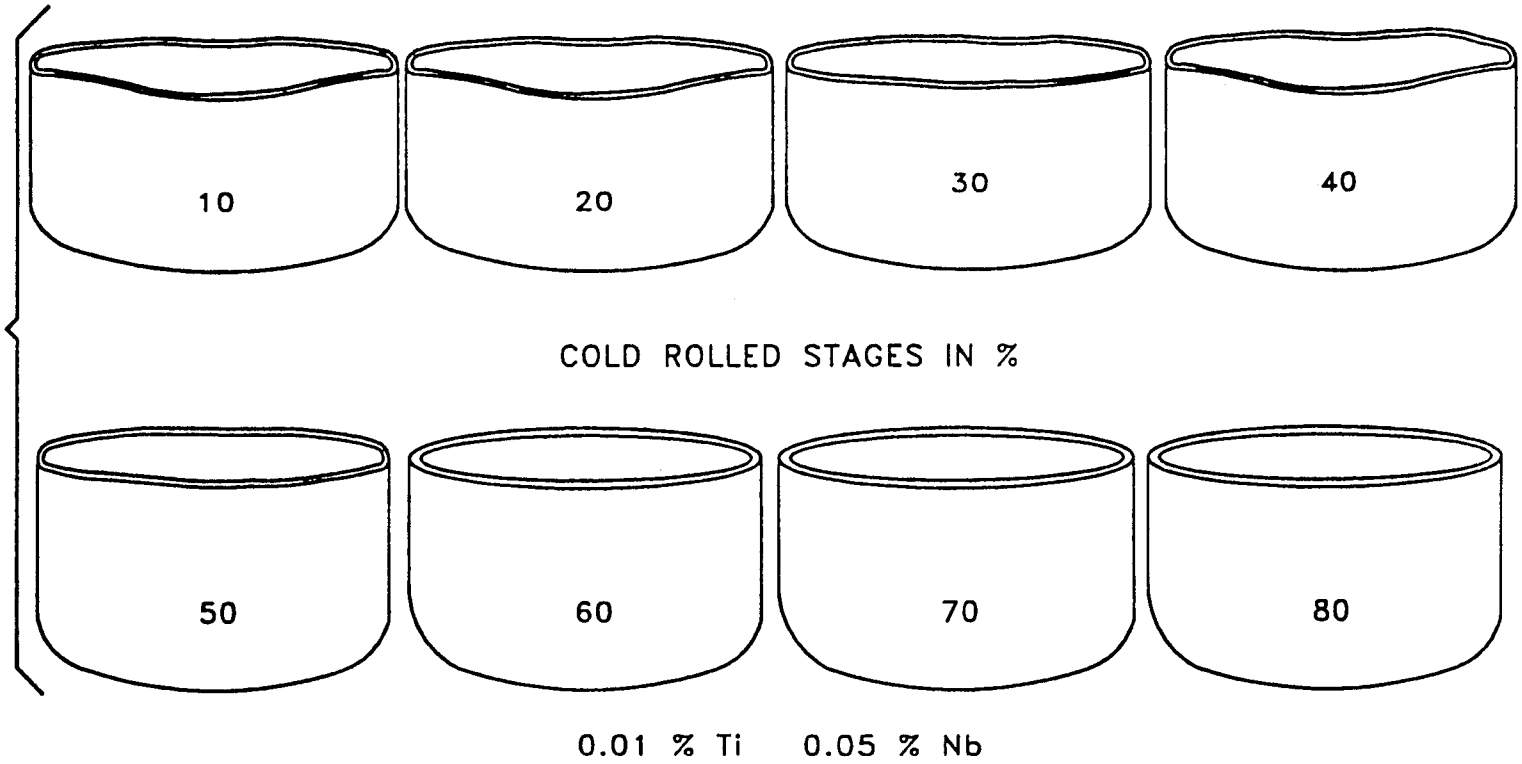

With the use of the steels G through I, rolled and annealed according to the invention, the cups demonstrated a slightly different deep drawing result at various cold rolling reductions, depending on the titanium content. The test results were as follows:

Steel G with 0.01% titanium (FIG. 13)

The cups were in the slightly eared category at cold rolling reductions of epsilon=45–85%, and more particularly relatively ear-free at reductions of approximately 60% to 80%.

Figure 14:
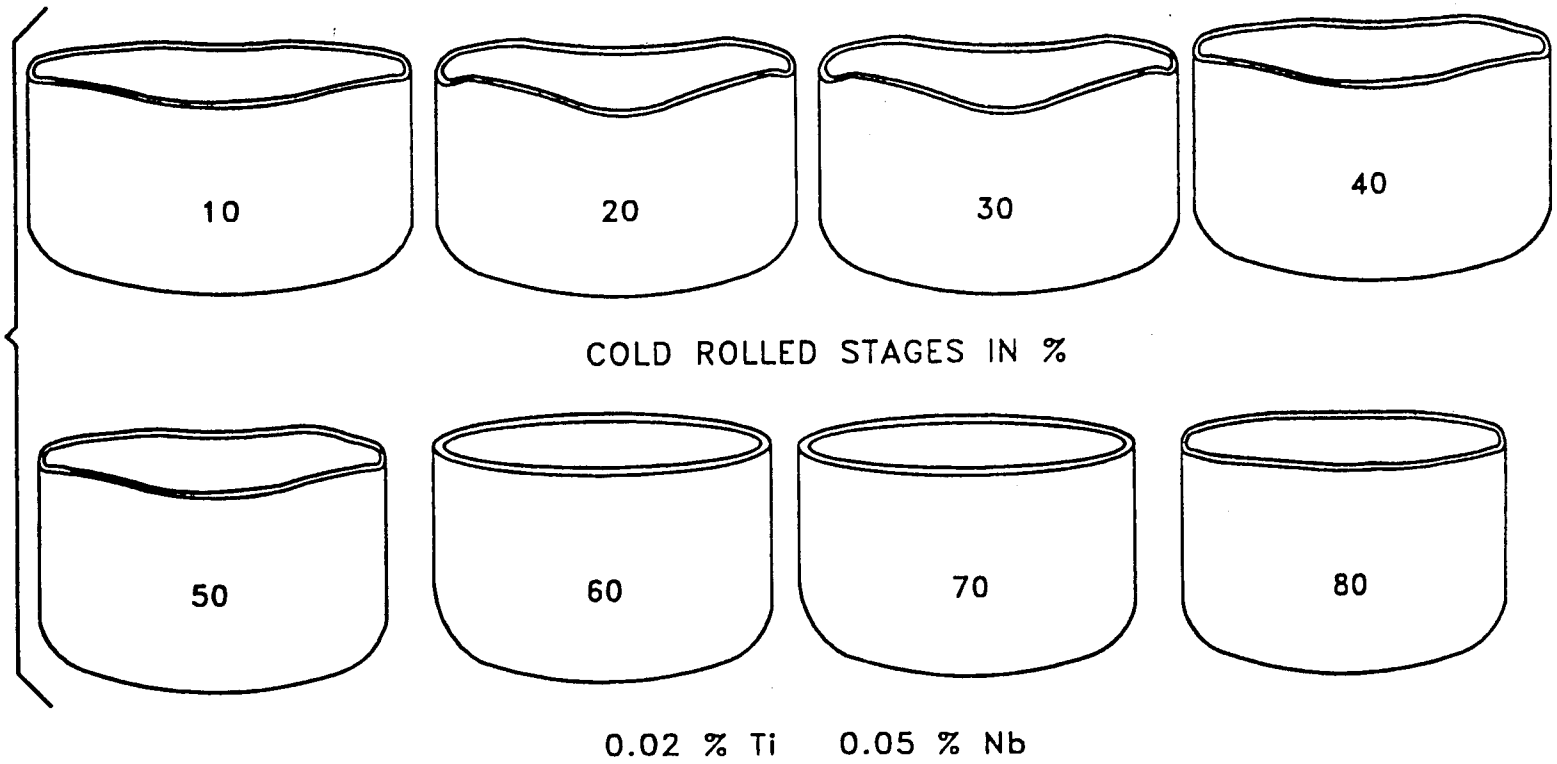

Steel H with 0.02% titanium (FIG. 14)

Slightly eared in the range epsilon=55–85%.
Virtually ear-free in the range from 60 to 75%.

Figure 15:
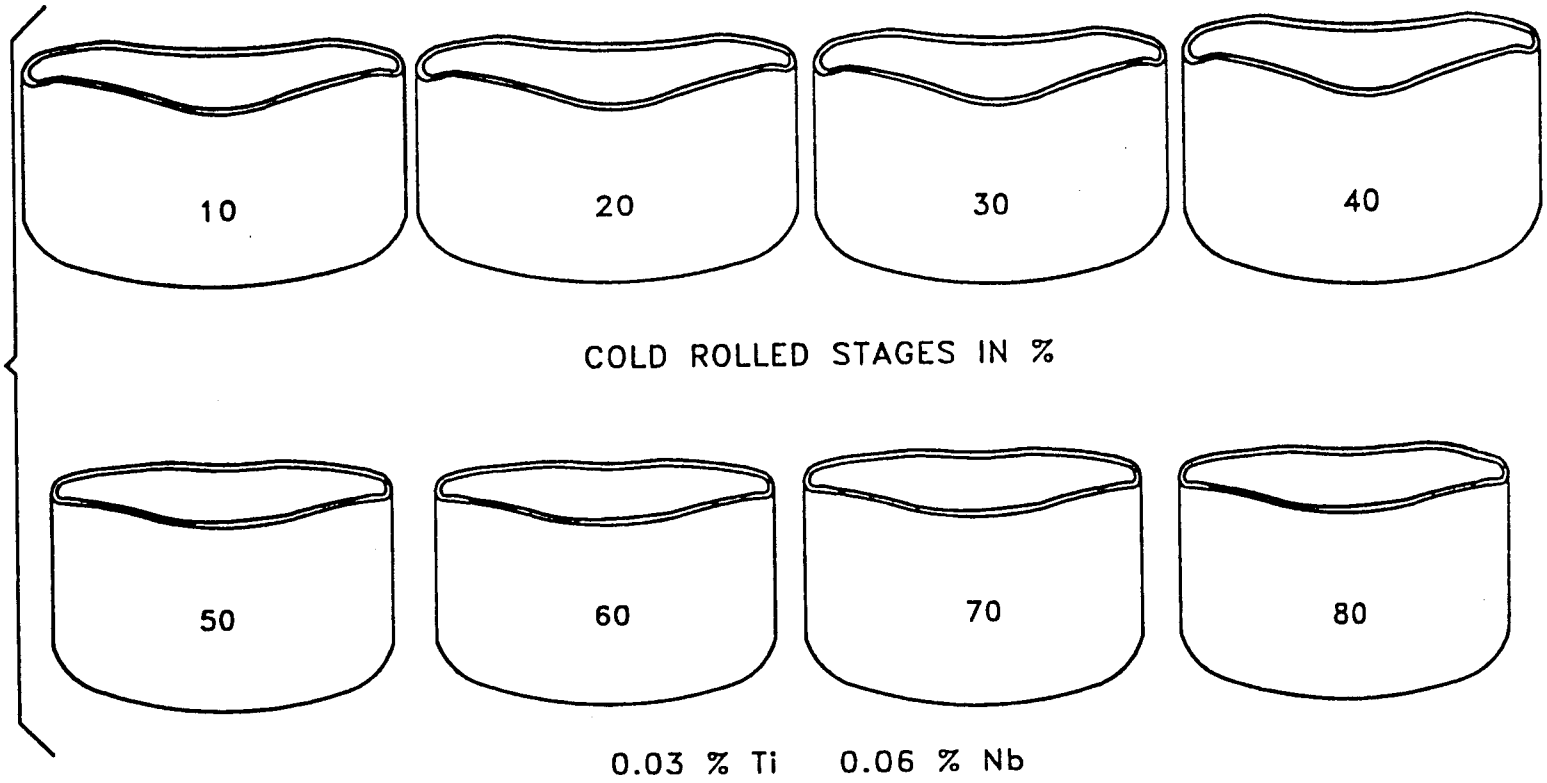

Steel I with 0.03% titanium (FIG. 15)

Slightly eared in the range from 60 to 70% reductions.

With the steels produced according to the invention, with a titanium content of 0.01%, it was possible, for example, to observe, in the deep drawn sheet yield point and tensile strength, values which were more than 50 N/mm$^2$ higher than the characteristic values of the material simply alloyed with titanium.

Figure 17:
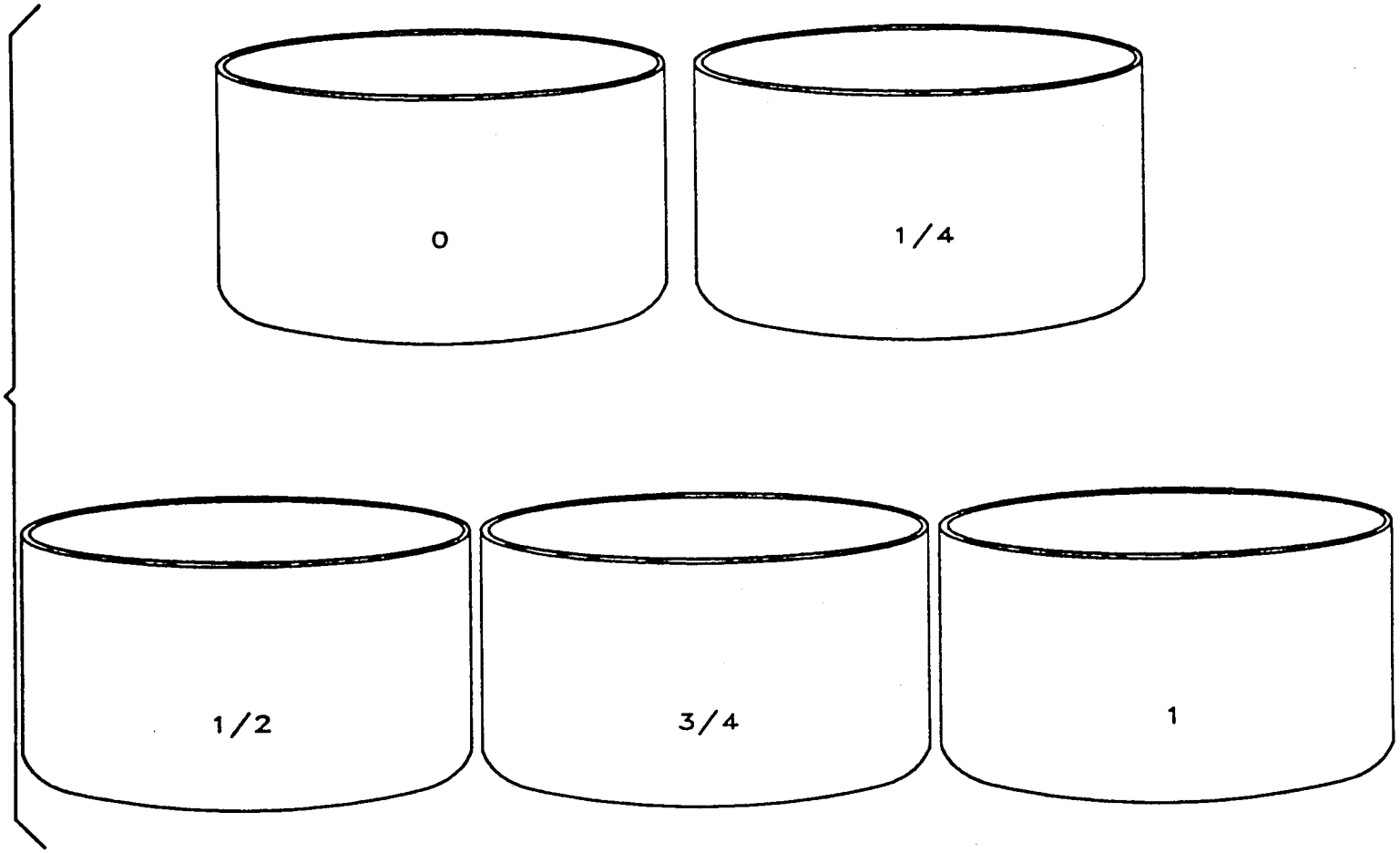
Figure 18:
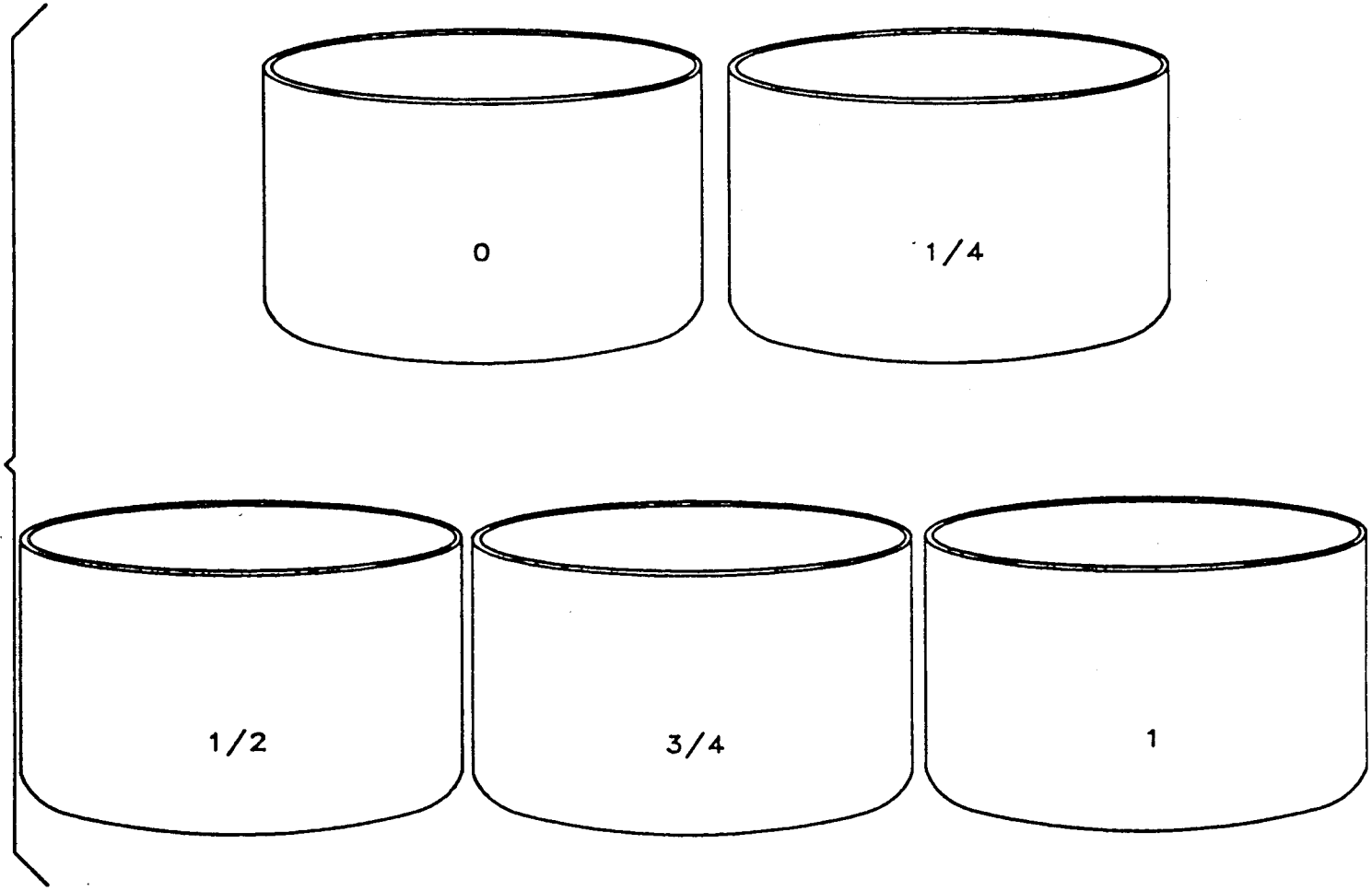

The melts L or M, according to the invention and listed in Table 1, with phosphorus contents at the upper analytical limit, were processed in the same manner as the steels A–F. The winding temperature was 510 or 500 degrees Celsius. At a cold rolling reduction of 66%, the consistency of the results was tested over the entire length of the strip to confirm the efficiency of the coiled annealing. The cups from the deep drawing tests are shown in FIGS. 17 and 18. These figures illustrate that ear-free material was produced at the beginning of the strip (position 0), and in each quarter of the length of the strip, all the way to the end of the strip (position 1).

TABLE 1

| Steel | C | Si | Mn | P | S | Al | N | Ti | Nb | Comments | FIG. |
|---|---|---|---|---|---|---|---|---|---|---|---|
| | Melt composition (Values in weight percentages) | | | | | | | | | | |
| A | 0.046 | 0.02 | 0.17 | 0.009 | 0.011 | 0.022 | 0.0025 | 0.01 | — | | 3 |
| B | 0.044 | 0.025 | 0.25 | 0.013 | 0.005 | 0.054 | 0.0032 | 0.02 | — | | 4 |
| C | 0.048 | 0.03 | 0.24 | 0.014 | 0.006 | 0.051 | 0.0034 | 0.03 | — | | 2, 5, 6 |
| D | 0.03 | 0.03 | 0.20 | 0.012 | 0.005 | 0.078 | 0.0050 | 0.04 | — | | 7 |
| E | 0.04 | 0.02 | 0.25 | 0.020 | 0.015 | 0.061 | 0.0033 | — | — | Reference | 8 |
| F | 0.04 | 0.03 | 0.25 | 0.008 | 0.007 | 0.065 | 0.0047 | — | — | Reference | 9 |
| G | 0.08 | 0.06 | 0.58 | 0.015 | 0.008 | 0.043 | 0.0038 | 0.01 | 0.05 | | 13 |
| H | 0.08 | 0.10 | 0.54 | 0.010 | 0.002 | 0.046 | 0.0039 | 0.02 | 0.05 | | 14 |
| I | 0.08 | 0.09 | 0.56 | 0.015 | 0.005 | 0.049 | 0.0046 | 0.03 | 0.06 | | 15 |
| K | 0.06 | 0.40 | 1.11 | 0.018 | 0.006 | 0.043 | 0.0039 | — | 0.05 | Reference | 16 |
| L | 0.04 | 0.04 | 0.22 | 0.077 | 0.011 | 0.073 | 0.005 | 0.03 | — | | 17 |
| M | 0.06 | 0.04 | 0.78 | 0.068 | 0.011 | 0.047 | 0.007 | 0.025 | — | | 18 |

TABLE 2

| Steel | Tw °C. | Th °C. | K min/max | FIG. |
|---|---|---|---|---|
| 1 | 860 | 490 | 10/7 | 3 |
| B | 870 | 500 | 11/9 | 4 |
| C1 | 870 | 500 | 11/9 | 5 |
| C2 | 880 | 450 | 11/9 | 6 |
| D | 890 | 430 | 11/9 | 7 |
| E | 900 | 710 | 9/4 | 8 |
| F | 890 | 500 | 9/6 | 9 |

TABLE 3

| Steel | Tw °C. | Th °C. | Pg t/h | K | delta r min/max | FIG. |
|---|---|---|---|---|---|---|
| C3 | 880 | 520 | 1.1 | 9-10 | −0.07/+0.06 | 2a |
| C4 | 915 | 540 | 1.9 | 9-10 | −0.04/+0.08 | 2b |
| C5 | 870 | 710 | 1.9 | 8-9 | +0.09/+0.17 | 2c |

Key to Tables 2 and 3
Tw = final rolling temperature
Th = Winding temperature
K = Grain size according to ASTM
Pg = Annealing throughput
r = Planar anisotropy In summary, one feature of the invention resides broadly in a process for production of a cold rolled sheet or strip with good deformability from steel with the following composition in weight percentages:

| | |
|---|---|
| max. 0.10 | % carbon |
| max. 0.40 | % silicon |
| 0.10 to 1.0 | % manganese |
| max. 0.08 | % phosphorus |
| max. 0.02 | % sulfur |
| max. 0.009 | % nitrogen |
| 0.015 to 0.08 | % aluminum |
| 0.01 to 0.04 | % titanium |
| max. 0.15 | % of one or more of the elements from the group copper, vanadium, nickel, |

remainder iron and unavoidable impurities, which is annealed after hot rolling and cold rolling, characterized in that the slab is heated above 1120° C. and rolled into hot rolled strip at a final rolling temperature above $Ar_3$ and wound at 520°±100° C. and recrystallization annealed in the coil after the cold rolling.

Another feature of the invention resides broadly in a process for production of a cold rolled sheet or strip characterized in that it is cold rolled at the following reduction rates (epsilon) depending on the titanium content:

approx. 0.01% titanium:
epsilon 20–60%
preferably 30–50%
approx. 0.02% titanium:
epsilon 5–20%,
preferably 10–15% or
epsilon 40–85%,
preferably 50–80%
approx. 0.03% titanium:
epsilon 5–25%,
preferably 10–20% or
epsilon 50–85%,
preferably 60–80%
approx. 0.04% titanium:
epsilon 15–25%, preferably 20% or epsilon 55–80%, preferably 60–70% and then recrystallization annealed at temperatures below $A_1$ and then dressed at a reduction rate of approx. 1%.

Yet another feature of the invention resides broadly in a process characterized in that a steel is used which also contains 0.01 to 0.06% niobium. For this steel a further feature of the invention resides broadly in a process for production of a cold rolled sheet or strip characterized in that it is cold rolled at the following reduction rates (epsilon) depending on the titanium content:

approx. 0.01% titanium: epsilon 45 to 85%,
approx. 0.02% titanium: epsilon 55 to 85%,
approx. 0.03% titanium: epsilon 60 to 70%, and then recrystallization annealed at temperatures below $A_1$ and then dressed at a reduction rate of approx. 1%.

A yet further feature of the invention resides broadly in a process characterized in that the steel is annealed in the tight reel after the cold rolling.

Yet another further feature of the invention resides broadly in a sheet or strip suitable for deep drawing made from steel of the composition reported and produced, characterized by a recrystallized structure with a ferritic grain size finer than ASTM 7 for a titanium content of 0.01% and finer than ASTM 9 for titanium contents of 0.015 to 0.04%.

An additional feature of the invention resides broadly in a sheet or strip suitable for deep drawing characterized in that the titanium content is at least 3.5 times the nitrogen content.

A yet additional feature of the invention resides broadly in the use of a sheet or strip produced according to one of the processes for the ear-free deep drawing preferably of rotationally symmetric parts.

A further additional feature of the invention resides broadly in the use of a steel for the production of deep drawn, preferably rotationally symmetric parts.

A yet further additional feature of the invention resides broadly in a process for production of a cold rolled sheet or strip with good quasi-isotropic deformability from steel with the following composition in weight percentages:

| | |
|---|---|
| 0.03-0.08 | % carbon |
| max. 0.40 | % silicon |
| 0.10 to 1.0 | % manganese |
| max. 0.08 | % phosphorus |
| max. 0.02 | % sulfur |
| max. 0.009 | % nitrogen |
| 0.015 to 0.08 | % aluminum |
| 0.01 to 0.04 | % titanium |
| max. 0.15 | % of one or more of the elements from the group copper, vanadium, nickel, |

remainder iron and unavoidable impurities, in which the slab is heated to above 1120 degrees Celsius and rolled into hot rolled strip at a final rolling temperature above $Ar_3$ and wound at 520°±100° C. and recrystallization annealed in the coil after cold rolling.

Another further additional feature of the invention resides broadly in a process for production of a cold rolled sheet or strip with good quasi-isotropic deforming properties, whereby the planar anisotropy assumes values in the range from approximately delta r±0.1, from steel with the following composition in weight percentages:

| | |
|---|---|
| 0.025-0.10 | % carbon |
| max. 0.40 | % silicon |
| 0.10 to 1.0 | % manganese |
| max. 0.08 | % phosphorus |
| max. 0.015 | % sulfur |
| max. 0.009 | % nitrogen |
| 0.015 to 0.08 | % aluminum |
| 0.01 to 0.04 | % titanium |
| max. 0.15 | % of one or more of the elements from the group copper, vanadium, nickel, |

remainder iron and unavoidable impurities, by heating a slab to above 1120° C. rolling into hot rolled strip at a final rolling temperature above $Ar_3$, winding at 520°±100° C. old rolling, and then recrystallization annealing. A yet another additional feature of the invention resides broadly in a process for production of a cold rolled sheet or strip with good quasi-isotropic reformability from steel with the following composition in weight percentages:

| | |
|---|---|
| 0.03-0.08 | % carbon |
| max. 0.40 | % silicon |
| 0.10 to 1.0 | % manganese |
| max. 0.08 | % phosphorus |
| max. 0.02 | % sulfur |
| max. 0.009 | % nitrogen |
| 0.015 to 0.08 | % aluminum |
| 0.01 to 0.04 | % titanium |
| max. 0.15 | % of one or more of the elements from the group copper, vanadium, nickel, |
| 0.01 to 0.06 | % niobium |

remainder iron and unavoidable impurities, in which the slab is heated to above 1120 degrees Celsius and rolled into hot rolled strip at a final rolling temperature above $Ar_3$ and wound at 520±100 degrees Celsius and then cold rolled at the following reduction rates (epsilon) depending on the titanium content:

approx. 0.01% titanium:epsilon 45 through 85%
approx. 0.02% titanium:epsilon 55 through 85%
approx. 0.03% titanium:epsilon 60 through 70% and then recrystallization annealed in the coil at temperatures below $A_1$ and then dressed at a reduction rate of approx. 1%.

Various aspects of rolled steel products are disclosed in U.S. Pat. No. 4,857,117, issued Aug. 15, 1989 to Sakata et al and entitled "Method of Manufacturing a Cold-Rolled Steel Sheet Having Good Deep Drawability"; U.S. Pat. No. 3,951,696, issued Apr. 20, 1986 to Gondo et al. and entitled "Method for Producing a High-Strength Cold Rolled Sheet Having Excellent Press-Formability"; U.S. Pat. No. 4,415,382, issued Nov. 15, 1983 to Gaskey et al, and entitled "Continuous Annealing Apparatus and Method"; U.S. Pat. No. 4,421,573, issued Dec. 20, 1983 to Irie et al and entitled "Method for Producing Hot-Rolled Dual-Phase High-Tensile Steel Sheets"; and U.S. Pat. No. 4,125,416, issued Nov. 14, 1978 to Katoh et al and entitled "Method for Producing Steel Strip or Steel Sheet Containing Carbide and Nitride Forming Elements".

Recrystallization and annealing techniques are discussed in U.S. Pat. No. 3,876,390, issued on Apr. 8, 1975 to Elias and entitled "Columbium Treated Non-Aging, Vaccumn Degassed Low Carbon Steel and Method for Producing Same; U.S. Pat. No. 4,076,572, issued Feb. 28, 1978 to Kimura and entitled "Crystal Growth and Anneal of Lead Tin Telluride By Recrystallization From Heterogeneous System"; U.S. Pat. No. 4,732,622, issued Mar. 22, 1988 to Jones and entitled "Processing of High Temperature Alloys"; and U.S. Pat. No. 4,035,248 issued Jul. 12, 1977 to Asano et al and entitled "Method for the Manufacture of a Steel Sheet Having a Ni-Defused Base Layer Which is Treated With a Chromic Acid".

Further U.S. patent which relate to the cold-rolling of steel sheets are U.S. Pat. No. 4,586,966 issued to Okamo and entitled "Method of Producing Cold-Rolled Exhibiting Improved Press-Formability"; U.S. Pat. No. 4,576,6578 issued to Satoh and entitled "Process of Manufacturing a Cold Rolled Steel Sheet Having Excellent Press Formability"; U.S. Pat. No. 4,517,031 issued to Takasaki and entitled "Method of Manufacturing Cold Rolled Steel Sheets for Extra Deep Drawing With an Excellent Press Formability"; and U.S. Pat. No. 4,313,770 issued to Takahashi and entitled "Method of Producing Cold Rolled Strip Having Improved Press Formability and Bake-Hardenability".

The temperature $A_1$ and $Ar_3$ are well known in the art of metallurgy and are described in the standard reference work "Metals Handbook (Tenth Edition), Volume 1, Properties and Selection: Irons, Steels and High-Performance Alloys", prepared under the direction of the ASM International Handbook Committee and published by ASM International, Materials Park, Ohio, 44073.

The ASTM standards referred to herein are also well known in the pertinent field of art and are set forth, for example, in the "Annual Book of ASTM Standards (1989 edition), Volume 02.01", for example, at least at pp. 835-860, often referred to in the trade by the so-called "E 112" designation.

All, or substantially all, of the components and methods of the various embodiments may be use with at least one embodiment or all of the embodiments, if any, desired herein.

All of the patents, patent applications and publications recited herein, if any, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

What is claimed is:

1. A process for the production of a cold rolled steel product, said process comprising the steps of:
   producing a melt to form a steel comprising the following, by weight percentages:
   from about 0.03 to about 0.10% of carbon;
   less than or equal to about 0.40% of silicon;
   from about 0.10 to about 1.0% manganese;
   less than or equal to about 0.08% of phosphorus;
   less than or equal to about 0.02% of sulfur;
   less than or equal to about 0.009% of nitrogen;
   from about 0.015 to about 0.08% of aluminum;
   from about 0.01 to about 0.04% of titanium; and
   less than or equal to about 0.15% of at least one of the elements from the group copper, vanadium, nickel;
   with the remainder being iron and impurities; forming said melt into a slab;
   heating said slab;
   rolling said slab at a final rolling temperature above $Ar_3$;
   winding the product;
   cold rolling the product; and
   recrystallization annealing the product, said recrystallization annealing step being carried out on said product in a coiled form.

2. The process according to claim 1, wherein said slab is heated to a temperature above about 1120° C., and wherein said product is wound at a temperature of between about 420° C. and about 620° C.

3. The process for the production of a cold rolled steel product according to claim 2, wherein the weight percentage of carbon of said melt is less than or equal to about 0.08.

4. The process for the production of a cold rolled steel product, according to claim 3, wherein said melt contains between about 0.01% and about 0.04% titanium, and wherein, the rate of reduction (epsilon) achieved is between about 5% and about 85%.

5. A process for the production of a cold rolled steel product, said process comprising the steps of:
   producing a melt to form a steel having the following composition, in weight percentages:
   from about 0.03 to about 0.10% of carbon;
   less than or equal to about 0.40% of silicon;
   from about 0.10 to about 1.0% of manganese;
   less than or equal to about 0.08% of phosphorus;
   less than or equal to about 0.02% of sulfur;
   less than or equal to about 0.009% of nitrogen;
   from about 0.015 to about 0.08% of aluminum;
   from about 0.01 to about 0.04% of titanium; and
   less than or equal to about 0.15% of at least one of the elements from the group consisting of copper, vanadium, nickel;
   from about 0.01 to about 0.06% of niobium;
   with the remainder being iron and impurities; producing a slab from said melt; heating said slab to a temperature of above 1120° C.;
   rolling the product into a hot rolled strip at a final rolling temperature above $Ar_3$;
   winding the product at a temperature of 520° C.±100° C.;
   cold rolling the product, the rate of reduction (epsilon) achieved during said cold rolling step being dependent upon the titanium content of said melt, and wherein titanium content of said melt is between about 0.01% and about 0.03% and the rate of reduction (epsilon) achieved is between about 45% and about 85%;
   recrystallization annealing the product at a temperature below $A_1$, said recrystallization step being carried out with the product in a coiled configuration; and
   dressing the product at a reduction rate of about 1%.

6. A cold rolled steel product suited for deep drawing, said cold rolled steel product being produced according to a process for the production of a cold rolled steel product, said process comprising the steps of:
   producing a melt to form a steel comprising the following, by weight percentages:
   from about 0.03 to about 0.10% of carbon;
   less than or equal to about 0.40% of silicon;
   from about 0.10 to about 1.0% of manganese;
   less than or equal to about 0.08% of phosphorus;
   less than or equal to about 0.02% of sulfur;
   less than or equal to about 0.009% of nitrogen;
   from about 0.015 to about 0.08% of aluminum;
   from about 0.01 to about 0.04% of titanium; and
   less than or equal to about 0.15% of at least one of the elements from the group consisting of copper, vanadium and nickel;
   with the remainder being iron and impurities; forming said melt into a slab;
   heating said slab to a temperature above about 1120° C.;
   rolling said slab at a final rolling temperature above $Ar_3$;
   winding the product at a temperature of about 520° C.±100° C.;
   cold rolling the product; and
   recrystallization annealing the product, said recrystallization annealing step being carried out on said product in a coiled form;
   wherein said cold rolled steel product has a recrystallized structure with a ferritic grain size which is between about ASTM 7 and ASTM 9, and wherein said melt has a titanium content between about 0.01% and about 0.04%.

7. A cold rolled steel product adapted for deep drawing, said cold rolled steel product being produced according to a process for the production of a cold rolled steel product, said process comprising the steps of:
   producing a melt to form a steel comprising the following, by weight percentages:
   from about 0.03 to about 0.10% of carbon;
   less than or equal to about 0.40% of silicon;
   from about 0.10 to about 1.0% of manganese;
   less than or equal to about 0.08% of phosphorus;
   less than or equal to about 0.02% of sulfur;

less than or equal to about 0.009% of nitrogen;
from about 0.015 to about 0.08% of aluminum;
from about 0.01 to about 0.04% of titanium; and
less than or equal to about 0.15% of at least one of the elements from the group consisting of copper, vanadium, and nickel;
with the remainder being iron and impurities; forming said melt into a slab;
heating said slab to a temperature above about 1120° C.;
rolling said slab at a final rolling temperature above $Ar_3$;
winding the product at a temperature of about 520° C.±100° C.;
cold rolling the product;
wherein the rate of reduction (epsilon) achieved during said cold rolling step is between about 10% and about 80%, and wherein said melt contains between about 0.01% and about 0.04% titanium;
recrystallization annealing the product, said recrystallization annealing step being carried out on said product in a coiled form; and dressing the product at a reduction rate of about 1%;
wherein said cold rolled steel product has a recrystallized structure with a ferritic grain size which is between about ASTM, 7 and ASTM 9.

8. A cold rolled steel product adapted for deep drawing, said cold rolled steel product being produced according to a process for the production of a cold rolled steel product, said processing comprising the steps of:
producing a melt to form a steel having the following composition, in weight percentages:
from about 0.03 to about 0.10% of carbon;
less than or equal to about 0.40% of silicon;
from about 0.10 to about 1.0% of manganese;
less than or equal to about 0.08% of phosphorus;
less than or equal to about 0.02% of sulfur;
less than or equal to about 0.009% of nitrogen;
from about 0.015 to about 0.08% of aluminum;
from about 0.01 to about 0.04% of titanium; and
less than or equal to about 0.15% of at least one of the elements from the group consisting of copper, vanadium and nickel;
from about 0.01 to about 0.06% of niobium;
with the remainder being iron and impurities; producing a slab from said melt;
heating said slab to a temperature of above 1120° C.;
rolling the product into a hot rolled strip at a final rolling temperature above $Ar_3$;
winding the product at a temperature of 520° C.±100° C.;
cold rolling the product, the rate of reduction (epsilon) achieved during said cold rolling step is between about 45% and about 85%, and wherein the titanium content of said melt is between about 0.01% and about 0.03%;
recrystallization annealing the product at a temperature below $A_1$, said recrystallization step being carried out with the product in a coiled configuration; and
dressing the product at a reduction rate of about 1%;
wherein said cold rolled steel product has a recrystallized structure with a ferritic grain size which is between about ASTM 7 and ASTM 9, and wherein said melt has a titanium content which is between about 0.01% and about 0.04%.

9. A rotationally symmetrical, substantially ear-free, deep drawn steel part produced from a cold rolled steel product adapted for deep drawing, said cold rolled steel product being produced according to a process for the production of a cold rolled steel product, said process comprising the steps of:
producing a melt to form a steel having the following composition, in weight percentages:
from about 0.03 to about 0.08% of carbon;
less than or equal to about 0.40% of silicon;
from about 0.10 to about 1.0% of manganese;
less than or equal to about 0.08% of phosphorus;
less than or equal to about 0.02% of sulfur;
less than or equal to about 0.009% of nitrogen;
from about 0.015 to about 0.08% of aluminum;
from about 0.01 to about 0.04% of titanium; and
less than or equal to about 0.15% of at least one of the elements from the group consisting of copper, vanadium and nickel;
with the remainder being iron and impurities; producing a slab from said melt;
heating said slab to a temperature of above 1120° C.;
rolling the product into a hot rolled strip at a final rolling temperature above $Ar_3$;
winding the product at a temperature of 520° C.±100° C.;
cold rolling the product, the rate of reduction (epsilon) achieved during said cold rolling step is dependent upon the titanium content of said melt, and wherein said rate of reduction is between about 10% and about 80% and the titanium content of said melt is between about 0.01% and about 0.04%;
recrystallization annealing the product at a temperature below $A_1$, said recrystallization step being carried out with the product in a coiled configuration; and
dressing the product at a reduction rate of about 1%;
wherein said cold rolled steel product has a recrystallized structure with a ferritic grain size which is between about ASTM 7 and ASTM 9, and wherein said melt has a titanium content which is between about 0.01% and about 0.04%;
and wherein said titanium content of said melt is substantially at least 3.5 times the nitrogen content of said melt.

10. A rotationally symmetrical, substantially ear-free, deep drawn steel part produced from a cold rolled steel product adapted for deep drawing, said cold rolled steel product being produced according to a process for the production of a cold rolled steel product, said process comprising the steps of:
producing a melt to form a steel having the following composition, in weight percentages:
from about 0.03 to about 0.08% of carbon;
less than or equal to about 0.40% of silicon;
from about 0.10 to about 1.0% of manganese;
less than or equal to about 0.08% of phosphorus;
less than or equal to about 0.02% of sulfur;
less than or equal to about 0.009% of nitrogen;
from about 0.015 to about 0.08% of aluminum;
from about 0.01 to about 0.04% of titanium; and
less than or equal to about 0.15% of at least one of the elements from the group consisting of copper, vanadium, and nickel;
from about 0.01 to about 0.06% of niobium;
with the remainder being iron and impurities; producing a slab from said melt;

heating said slab to a temperature of above 1120° C.;

rolling the product into a hot rolled strip at a final rolling temperature above $Ar_3$;

winding the product at a temperature of 520° C.±100° C.;

cold rolling the product, the rate of reduction (epsilon) achieved during said cold rolling step is dependent upon the titanium content of said melt, as follows:

wherein, when the titanium content of said melt is between about 0.01% and about 0.03%;

and wherein the rate of reduction (epsilon) achieved is between about 60% and about 85%;

recrystallization annealing the product at a temperature below $A_1$, said recrystallization step being carried out with the product in a coiled configuration; and dressing the product at a reduction rate of about 1%;

wherein said cold rolled steel product has a recrystallized texture with a ferritic grain size which is between about ASTM 7 and ASTM 9;

wherein said melt has a titanium content of between about 0.01% and about 0.04%; and wherein said titanium content of said melt is substantially at least 3.5 times the nitrogen content of said melt.

11. The process for the production of a cold rolled steel product according to claim 4, wherein the rate of reduction (epsilon) achieved during said cold rolling step is dependent upon the titanium content of said melt, and wherein said rate of reduction and said titanium content are one of the following:

wherein said melt contains about 0.01% titanium and the rate of reduction (epsilon) achieved is about 20% to about 60%;

wherein said melt contains about 0.02% titanium and the rate of reduction (epsilon) achieved is at least one of about 5% to about 20% and about 40% to about 85%;

wherein said melt contain about 0.03% titanium and the rate of reduction (epsilon) achieved is at least one of about 5% to about 25% and about 50% to about 85%; and wherein said melt contains about 0.04% titanium and the rate of reduction (epsilon) achieved is at least one of about 15% to about 25% and about 55% to about 80%.

12. The process for the production of a cold rolled steel product according to claim 5, wherein said rate of reduction and said titanium content are one of the following:

wherein the titanium content of said melt is about 0.01% and the rate of reduction (epsilon) achieved is about 45% through about 85%;

wherein the titanium content of said melt is about 0.02% and the rate of reduction (epsilon) achieved is about 55% through about 85%; and wherein the titanium content of said melt is about 0.03% and the rate of reduction (epsilon) achieved is about 60% through about 70%.

13. The cold rolled steel product according to claim 6, wherein said cold rolled steel product has a recrystallized structure with a ferritic grain size which is at least one of the following:

a ferritic grain size finer than ASTM 7, with said melt having a titanium content of about 0.01%; and a ferritic grain size finer than ASTM 9, with said melt having a titanium content of about 0.015% to about 0.04%.

14. The cold rolled steel product according to claim 7, wherein the rate of reduction (epsilon) achieved during said cold rolling step is dependent upon the titanium content of said melt, and wherein said rate of reduction and said titanium content are one of the following:

wherein said melt contains about 0.01% titanium and the rate of reduction (epsilon) achieved is about 30% to about 50%;

wherein said melt contains about 0.02% titanium and the rate of reduction (epsilon) achieved is at least one of about 10% to about 15% and about 50% to about 80%;

wherein said melt contains about 0.03% titanium and the rate of reduction (epsilon) achieved is at least one of about 10% to about 20% and about 60% to about 80%; and wherein said melt contains about 0.04% titanium and the rate of reduction (epsilon) achieved is at least one of about 20% and about 60% to about 70%; and wherein said cold rolled steel product has a recrystallized structure with a ferritic grain size which is at least one of the following:

a ferritic grain size finer that ASTM 7, with said melt having a titanium, content of about 0.01%; and a ferritic grain size finer than ASTM 9, with said melt having a titanium content of about 0.015% to about 0.04%.

15. The cold rolled steel product according to claim 8, wherein said rate of reduction and said titanium content are one of the following:

wherein, when the titanium content of said melt is about 0.01%, the rate of reduction (epsilon) achieved is about 45% through about 85%;

wherein, when the titanium content of said melt is about 0.02%, the rate of reduction (epsilon) achieved is about 55% through about 85%; and wherein, when the titanium content of said melt is about 0.03%, the rate of reduction (epsilon) achieved is about 60% through about 70%; and wherein said cold rolled steel product has a recrystallized structure with a ferritic grain size which is at least one of the following:

a ferritic grain size finer than ASTM 7, with said melt having a titanium content of about 0.01%; and a ferritic grain size finer than ASTM 9, with said melt having a titanium content of about 0.015% to about 0.04%.

16. The deep drawn steel part according to claim 9, wherein said rate of reduction and said titanium content are one of the following:

wherein said melt contains about 0.01% titanium and the rate of reduction (epsilon) achieved is about 30% to about 50%;

wherein said melt contains about 0.02% titanium and the rate of reduction (epsilon) achieved is at least one of about 10% to about 15% and about 50% to about 80%;

wherein said melt contains about 0.03% titanium and the rate of reduction (epsilon) achieved is at least one of about 10% to about 20% and about 60% to about 80%; and wherein said melt contains about 0.04% titanium and the rate of reduction (epsilon) achieved is at least one of about 20% and about 60% to about 70%; and wherein said cold rolled steel product has a recrystallized structure with a ferritic grain size which is at least one of the following:

a ferritic grain size finer than ASTM 7, with said melt having a titanium content of about 0.01%; and a ferritic grain size finer than ASTM 9, with said melt having a titanium content of about 0.015% to about 0.04%.

17. The process for the production of a cold rolled steel product according to claim 4, wherein the rate of reduction (epsilon) achieved during said cold rolling step is dependent upon the titanium content of said melt, and wherein said rate of reduction and said titanium content are one of the following:

wherein said melt contains about 0.01% titanium, the rate of reduction achieved is about 30% to about 50%;

wherein said melt contains about 0.02% titanium, the rate of reduction (epsilon) achieved is at least one of about 10% to about 15% and about 50% to about 80%;

wherein said melt contains about 0.03% titanium, the rate of reduction (epsilon) achieved is at least one of about 10% to about 20% and about 60% to about 80%; and wherein said melt contains about 0.04% titanium, the rate of reduction (epsilon) achieved is at least one of about 20% and about 60% to about 70%.

18. The process for the production of a cold rolled steel product according to claim 4, wherein said recrystallization annealing step is carried out at a temperature below $A_1$, and wherein said process comprises the additional step of dressing said product at a reduction rate of about 1%.

19. The process for the production of a cold rolled steel product according to claim 17, wherein said recrystallization annealing step is carried out at a temperature below $A_1$, and wherein said process comprises the additional step of dressing said product at a reduction rate of about 1%.

20. The process for the production of a cold rolled steel product according to claim 5, wherein the weight percentage of carbon of said melt is from about 0.03 to about 0.08.

21. The process for the production of a cold rolled steel product according to claim 1, wherein said annealing step is carried out with the product configured in a substantially tightly reeled form.

22. The process for the production of a cold rolled steel product according to claim 5, wherein said annealing step is carried out with the product configured in a substantially tightly reeled form.

23. A cold rolled steel product according to claim 6, wherein said titanium content of said melt is substantially at least 3.5 times the nitrogen content of said melt.

24. A cold rolled steel product according to claim 8, wherein said titanium content of said melt is substantially at least 3.5 times the nitrogen content of said melt.

25. A substantially ear-free deep drawn steel part produced from the cold rolled steel product of claim 6, said process comprising the additional step of forming said substantially ear-free deep drawn steel part from said product following said recrystallization annealing step.

26. A substantially ear-free deep drawn steel part produced from the cold rolled steel product of claim 8, said process comprising the additional step of forming said substantially ear-free deep drawn steel part from said product following said recrystallization annealing step.

27. The substantially ear-free deep drawn steel part according to claim 25, wherein said deep drawn steel part is rotationally symmetrical.

28. The substantially ear-free deep drawn steel part according to claim 26, wherein said deep drawn steel part is rotationally symmetrical.

* * * * *

UNITED STATES PATENT AND TRADEMARK OFFICE

CERTIFICATE OF CORRECTION

PATENT NO. : 5,139,580

DATED : August 18, 1992

INVENTOR(S) : Klaus FREIER and Walter ZIMNIK

It is certified that error appears in the above-indentified patent and that said Letters Patent is hereby corrected as shown below:

under the Abstract section, item 57, line 4, delete "that" and insert --than--.

under the Abstract section, item 57, line 4, after 'to', delete "0.94%" and insert --0.04%--.

In column 6, line 23, after 'least', insert --one--.

In column 6, line 61, after 'of', delete "about" and insert --above--.

In column 8, line 14, after 'la-lc', delete "illustrates" and insert --illustrate--.

UNITED STATES PATENT AND TRADEMARK OFFICE

CERTIFICATE OF CORRECTION

PATENT NO. : 5,139,580

DATED : August 18, 1992

INVENTOR(S) : Klaus FREIER and Walter ZIMNIK

It is certified that error appears in the above-indentified patent and that said Letters Patent is hereby corrected as shown below:

In column 8, line 27, after 'or', insert --alloy--.

In column 8, lines 30-31, after 'composition', delete "D, FIG. 10e represents melt, steel or alloy composition D." and insert --D.--.

In column 8, line 35, delete "relative" and insert --relatively--.

In column 11, line 21, in TABLE 2, under the column labelled 'Steel', delete "1" and insert --A--.

In column 17, line 31, Claim 8, after 'said', delete "processing" and insert --process--.

In column 21, line 20, Claim 17, after 'reduction', insert --(epsilon)--.

Signed and Sealed this

Sixth Day of August, 1996

*Attest:*

*Attesting Officer*

Bruce Lehman

BRUCE LEHMAN

*Commissioner of Patents and Trademarks*